US009285696B2

(12) United States Patent
Shinya et al.

(10) Patent No.: US 9,285,696 B2
(45) Date of Patent: Mar. 15, 2016

(54) ELECTROSTATIC CHARGE IMAGE DEVELOPING TONER, ELECTROSTATIC CHARGE IMAGE DEVELOPER, AND TONER CONTAINER

(71) Applicant: FUJI XEROX CO., LTD., Tokyo (JP)

(72) Inventors: Tomohiro Shinya, Kanagawa (JP); Shinpei Takagi, Kanagawa (JP); Soichiro Kitagawa, Kanagawa (JP); Kiyohiro Yamanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/277,297

(22) Filed: May 14, 2014

(65) Prior Publication Data

US 2015/0072276 A1 Mar. 12, 2015

(30) Foreign Application Priority Data

Sep. 9, 2013 (JP) ..... 2013-186346

(51) Int. Cl.
*G03G 9/087* (2006.01)
*G03G 9/093* (2006.01)

(52) U.S. Cl.
CPC ..... *G03G 9/08726* (2013.01); *G03G 9/08755* (2013.01); *G03G 9/08793* (2013.01); *G03G 9/09328* (2013.01); *G03G 9/09364* (2013.01); *G03G 9/09371* (2013.01); *G03G 2215/0636* (2013.01)

(58) Field of Classification Search
CPC ..... G03G 9/08726; G03G 9/08755; G03G 9/08791; G03G 9/08795
See application file for complete search history.

(56) References Cited

U.S. PATENT DOCUMENTS

| | | | | |
|---|---|---|---|---|
| 8,652,731 | B2 * | 2/2014 | Sasaki | C08G 63/672 399/252 |
| 8,709,692 | B2 * | 4/2014 | Miyata | C08G 63/676 399/252 |
| 8,883,387 | B2 * | 11/2014 | Miyata | G03G 9/08755 399/252 |
| 2009/0011356 | A1 * | 1/2009 | Tomita et al. | 430/109.4 |
| 2010/0196817 | A1 * | 8/2010 | Sasaki et al. | 430/109.4 |
| 2013/0022905 | A1 * | 1/2013 | Sasaki | C08G 63/672 430/109.4 |
| 2013/0244170 | A1 * | 9/2013 | Miyata | G08G 63/676 430/124.1 |
| 2015/0234305 | A1 * | 8/2015 | Sasaki | C08G 63/183 527/604 |

FOREIGN PATENT DOCUMENTS

| | | | | |
|---|---|---|---|---|
| DE | 37 38 777 | * | 5/1988 | G03G 9/087 |
| JP | A-2007-139813 | | 6/2007 | |
| JP | A-2008-020631 | | 1/2008 | |

* cited by examiner

*Primary Examiner* — Peter Vajda
(74) *Attorney, Agent, or Firm* — Oliff PLC

(57) ABSTRACT

An electrostatic charge image developing toner includes an unsaturated polyester resin that contains a structural unit derived from a dicarboxylic acid component having an ethylenically unsaturated bond and a structural unit derived from a dialcohol component having a rosin ester group, wherein a surface layer portion of the toner contains a crosslinked material of the unsaturated polyester resin.

9 Claims, 2 Drawing Sheets

ELECTROSTATIC CHARGE IMAGE DEVELOPING TONER, ELECTROSTATIC CHARGE IMAGE DEVELOPER, AND TONER CONTAINER

CROSS-REFERENCE TO RELATED APPLICATIONS

This application is based on and claims priority under 35 USC 119 from Japanese Patent Application No. 2013-186346 filed Sep. 9, 2013.

BACKGROUND

1. Technical Field

The present invention relates to an electrostatic charge image developing toner, an electrostatic charge image developer, and a toner container.

2. Related Art

A method such as electrophotography in which image information is visualized through processes of forming an electrostatic latent image and developing the electrostatic latent image, is currently being used in various fields. In this method, an image is formed by charging the entire surface of a photoreceptor (image holding member), exposing the surface of the photoreceptor to laser beams corresponding to image information to form an electrostatic latent image, developing the electrostatic latent image using a developer containing toner to forma toner image, and finally transferring and fixing the toner image onto a surface of a recording medium.

SUMMARY

According to an aspect of the invention, there is provided an electrostatic charge image developing toner including:

an unsaturated polyester resin that contains a structural unit derived from a dicarboxylic acid component having an ethylenically unsaturated bond and a structural unit derived from a dialcohol component having a rosin ester group, wherein a surface layer portion of the toner contains a crosslinked material of the unsaturated polyester resin.

BRIEF DESCRIPTION OF THE DRAWINGS

Exemplary embodiments of the present invention will be described in detail based on the following figures, wherein.

DETAILED DESCRIPTION

Figure 1:
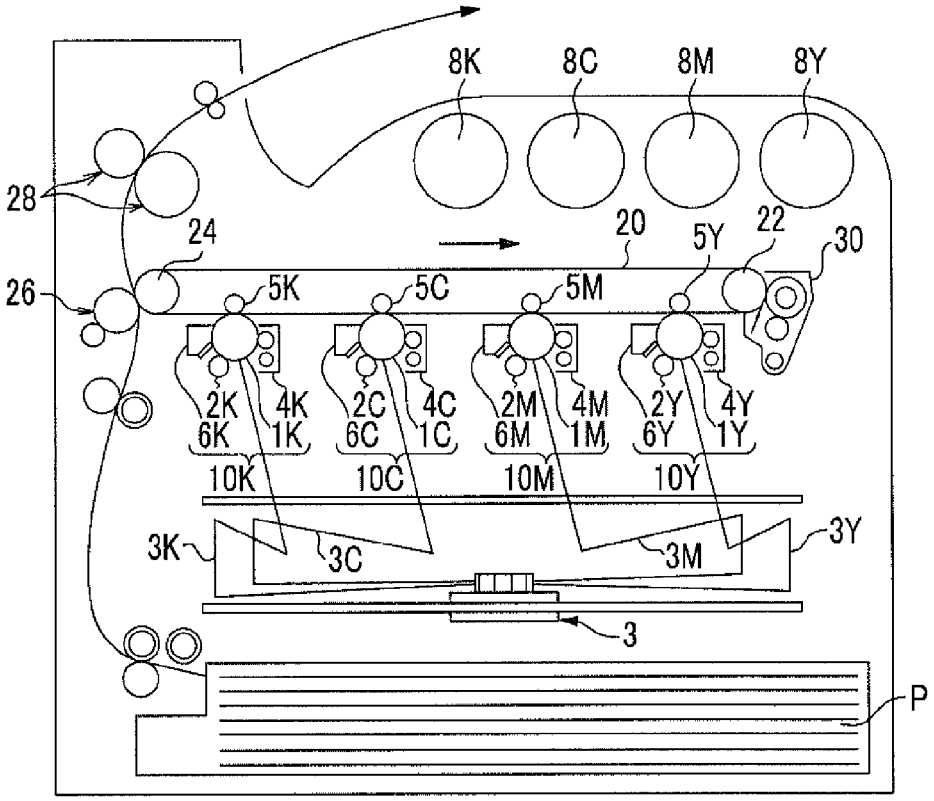
FIG. 1 is a schematic diagram illustrating a configuration example of an image forming apparatus according to an exemplary embodiment of the invention.

Hereinafter, exemplary embodiments of an electrostatic charge image developing toner, an electrostatic charge image developer, a toner cartridge, a process cartridge, an image forming apparatus, and an image forming method according to the invention will be described in detail.

Electrostatic Charge Image Developing Toner

An electrostatic charge image developing toner according to an exemplary embodiment of the invention (hereinafter, also referred to as "toner according to the exemplary embodiment") includes: an unsaturated polyester resin that contains a structural unit derived from a dicarboxylic acid component having an ethylenically unsaturated bond and a structural unit derived from a dialcohol component having a rosin ester group, in which a surface layer portion of the toner contains a crosslinked material of the unsaturated polyester resin.

As a toner having a superior low-temperature fixing property, a toner in which a polyester resin containing a rosin ester group is used as a binder resin is disclosed. However, in such a resin, a small amount of unreacted rosin having a low molecular weight remains, and a problem of filming occurs. In particular, during development under high stress conditions such as changes in environment, the unreacted rosin is likely to bleed from the surface of toner, and this problem may become significant.

With the toner according to the exemplary embodiment, filming is suppressed. The reason is not clear but is presumed to be as follows.

When the surface layer of the toner is crosslinked by, for example, a radical reaction in water by using the unsaturated polyester resin as the binder resin, the surface layer of the toner contains a crosslinked material of the unsaturated polyester resin. As a result, the exposure of the unreacted rosin component to the surface layer of the toner is prevented. In addition, when a rosin having an ethylenically unsaturated bond is used as the rosin component which is a base of the rosin ester group, the unsaturated polyester resin is crosslinked with the unreacted rosin having an ethylenically unsaturated bond, and thus the exposure of the unreacted rosin component to the surface layer of the toner is further prevented. In addition, the remaining amount of the unreacted rosin is reduced. As a result, filming is suppressed.

Hereinafter, the details of the toner according to the exemplary embodiment will be described.

The toner according to the exemplary embodiment includes toner particles and optionally may further include external additives.

Toner Particles

For example, the toner particles include a binder resin and optionally may further include a colorant, a release agent, and other additives.

Binder Resin

The toner according to the exemplary embodiment includes, as the binder resin, an unsaturated polyester resin (hereinafter, also referred to as "specific polyester resin") that contains a structural unit derived from a dicarboxylic acid component having an ethylenically unsaturated bond and a structural unit derived from a dialcohol component having a rosin ester group.

It is preferable that the ethylenically unsaturated bond contained in the molecules of the specific polyester resin have reactivity. However, "the reactivity" described in the exemplary embodiment represents that, when an aqueous dispersion containing 30% by weight of fine particles of the resin having a particle size of about 200 nm is heated to 80° C. under stirring, 5% by weight of a polymerization initiator (APS, manufactured by Mitsubishi Chemical Corporation) with respect to the resin is added thereto, and the reaction is continued for 2 hours, the gel content (THF insoluble content) in resin particles which is obtained by solid separation using a freezing drying machine is increased by 3% by weight or greater before and after the reaction. Hereinafter, the ethylenically unsaturated bond having the reactivity will also be simply referred to as the ethylenically unsaturated bond or the unsaturated bond.

The unsaturated bond equivalent of the specific polyester resin used in the exemplary embodiment is preferably 4000 g/eq or less, more preferably 1500 g/eq or less, and still more preferably 1000 g/eq or less.

In the exemplary embodiment, the unsaturated bond equivalent of the resin is a value measured with the following method.

The NMR analysis (H analysis) of the resin is performed to identify the kinds of monomers and the composition ratios thereof. Among the composition ratios, a ratio of a monomer having an unsaturated double bond is obtained to calculate the molecular weight per each unsaturated bond.

Carboxylic Acid Component

The dicarboxylic acid component having an ethylenically unsaturated bond used in the exemplary embodiment is not particularly limited, and examples thereof include fumaric acid, maleic acid, maleic anhydride, citraconic acid, mesaconic acid, itaconic acid, glutaconic acid, allylmalonic acid, isopropylidene succinic acid, acetylene dicarboxylic acid, and lower (the number of carbon atoms is from 1 to 4) alkyl esters thereof. The ethylenically unsaturated bond is preferably positioned in the main chain of polyester or a portion close to the main chain when being condensed from the viewpoint of the reactivity. A monomer such as alkenyl succinic acid having an unsaturated bond in a side chain distant from the main chain has poor reactivity and thus is not considered a polyvalent carboxylic acid having an unsaturated bond.

In the exemplary embodiment, optionally, a trivalent or higher polyvalent carboxylic acid may be used together. Examples of the trivalent or higher polyvalent carboxylic acid having an ethylenically unsaturated bond (for example, a vinyl group or a vinylene group) include aconitic acid, 3-butene-1,2,3-tricarboxylic acid, 4-pentene-1,2,4-tricarboxylic acid, 1-pentene-1,1,4,4-tetracarboxylic acid, and lower (the number of carbon atoms is from 1 to 4) alkyl esters thereof.

These polyvalent carboxylic acids may be used alone or in a combination of two or more kinds.

When the trivalent or higher polyvalent carboxylic acid is used together, a ratio (molar fraction) of the structural unit derived from a dicarboxylic acid component having an ethylenically unsaturated bond to structural units derived from all the carboxylic acids having an ethylenically unsaturated bond is preferably 60 mol % to 100 mol % and more preferably 85 mol % to 100 mol %.

In the exemplary embodiment, a polyvalent carboxylic acid component having no ethylenically unsaturated bond may be used together as a carboxylic acid component.

Examples of such a polyvalent carboxylic acid include aliphatic dicarboxylic acids (for example, oxalic acid, malonic acid, succinic acid, adipic acid, or sebacic acid); alicyclic dicarboxylic acids (for example, cyclohexane dicarboxylic acid); aromatic dicarboxylic acids (for example, terephthalic acid, isophthalic acid, phthalic acid, or naphthalene dicarboxylic acid); anhydrides of the above-described acids; and lower (for example, the number of carbon atoms is from 1 to 5) alkyl esters of the above-described acids. Among these, as the polyvalent carboxylic acid, aromatic dicarboxylic acids are preferable.

As the polyvalent dicarboxylic acid, a trivalent or higher polyvalent carboxylic acid having a crosslinked structure or a branched structure may be used in combination of a dicarboxylic acid. Examples of the trivalent or higher polyvalent carboxylic acid include trimellitic acid, pyromellitic acid, anhydrides thereof, and lower (for example, the number of carbon atoms is from 1 to 5) alkyl esters thereof.

When the polyvalent carboxylic acid component having no ethylenically unsaturated bond is used together, a ratio (molar fraction) of structural units derived from all the carboxylic acid components having an ethylenically unsaturated bond to structural units derived from all the carboxylic acid components is 30 mol % to 80 mol %

Alcohol Component

The dialcohol component having a rosin ester group used in the exemplary embodiment is not particularly limited, and examples thereof include a dialcohol component represented by the following formula (1).

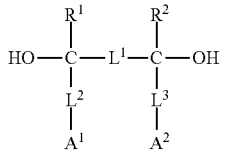

(1)

In the formula (1), $R^1$ and $R^2$ each independently represent hydrogen or a methyl group. $R^1$ and $R^2$ may be the same as or different from each other, but are preferably the same as each other. $L^1$, $L^2$, and $L^3$ each independently represent a divalent linking group selected from the group consisting of a carbonyl group, an ester group, an ether group, a sulfonyl group, a chain alkylene group which may have a substituent, a cyclic alkylene group which may have a substituent, an arylene group which may have a substituent, and combinations thereof. $L^1$ and $L^2$; or $L^1$ and $L^3$ may form a ring. $L^2$ and $L^3$ may be the same as or different from each other, but is preferably the same as each other. $A^1$ and $A^2$ represent a rosin ester group.

The dialcohol component represented by the formula (1) is a dialcohol compound containing two rosin ester groups in one molecule (hereinafter, also referred to as "specific rosin diol"). In the formula (1), $R^1$ and $R^2$ each independently represent hydrogen or a methyl group. $A^1$ and $A^2$ represent a rosin ester group. In the exemplary embodiment, the rosin ester group is a residue obtained by excluding a hydrogen atom from a carboxyl group contained in the rosin.

In the formula (1), $L^1$, $L^2$, and $L^3$ each independently represent a divalent linking group selected from the group consisting of a carbonyl group, an ester group, an ether group, a sulfonyl group, a chain alkylene group which may have a substituent, a cyclic alkylene group which may have a substituent, an arylene group which may have a substituent, and combinations thereof. $L^1$ and $L^2$; or $L^1$ and $L^3$ may form a ring.

Examples of the chain alkylene group represented by $L^1$, $L^2$, or $L^3$ include an alkylene group having from 1 to 10 carbon atoms.

Examples of the cyclic alkylene group represented by $L^1$, $L^2$, or $L^3$ include a cyclic alkylene group having from 3 to 7 carbon atoms.

Examples of the arylene group represented by $L^1$, $L^2$, or $L^3$ include a phenylene group, a naphthylene group, and an anthracene group.

Examples of the substituent of the chain alkylene group, the cyclic alkylene group, and the arylene group include an alkyl group having 1 to 8 carbon atoms and an aryl group, and a linear, branched, or cyclic alkyl group is preferable. Specific examples of the substituent include a methyl group, an ethyl group, a propyl group, a butyl group, a pentyl group, a hexyl group, a heptyl group, an octyl group, an isopropyl group, an isobutyl group, an s-butyl group, a t-butyl group, an isopentyl group, a neopentyl group, a 1-methylbutyl group, an isohexyl group, a 2-ethylhexyl group, a 2-methylhexyl group, a cyclopentyl group, a cyclohexyl group, and a phenyl group.

The specific rosin diol represented by the formula (1) may be synthesized with a well-known method, for example, may be synthesized by a reaction of a bifunctional epoxy compound and a rosin. An epoxy group-containing compound which may be used in the exemplary embodiment is a bifunctional epoxy compound containing two epoxy groups in one molecule, and examples thereof include diglycidyl ethers of aromatic diols, diglycidyl ethers of aromatic dicarboxylic acids, diglycidyl ethers of aliphatic diols, diglycidyl ethers of alicyclic diols, and alicyclic epoxides.

Representative examples of an aromatic diol component of the diglycidyl ethers of aromatic diols include bisphenol A; derivatives of bisphenol A such as a polyalkylene oxide adduct of bisphenol A; bisphenol F; derivatives of bisphenol F such as a polyalkylene oxide adduct of bisphenol F; bisphenol S; derivatives of bisphenol S such as a polyalkylene oxide adduct of bisphenol S; resorcinol; t-butylcatechol; and biphenol.

Representative examples of an aromatic dicarboxylic acid component of the diglycidyl ethers of aromatic dicarboxylic acids include terephthalic acid, isophthalic acid, and phthalic acid.

Representative examples of an aliphatic diol component of the diglycidyl ethers of aliphatic diols include ethylene glycol, 1,2-propanediol, 1,3-propanediol, 1,4-butanediol, 1,5-pentanediol, 1,6-hexanediol, neopentyl glycol, 1,9-nonanediol, diethylene glycol, triethylene glycol, polyethylene glycol, polypropylene glycol, and polytetramethylene glycol.

Representative examples of an alicyclic diol component of the diglycidyl ethers of alicyclic diols include hydrogenated bisphenol A; derivatives of hydrogenated bisphenol A such as a polyalkylene oxide adduct of hydrogenated bisphenol A; and cyclohexanedimethanol.

Representative examples of the alicyclic epoxides include limonene dioxide.

The epoxy group-containing compound may be obtained by, for example, a reaction of a diol component and an epihalohydrin and may be formed as a high molecular weight compound by polycondensation depending on the quantity ratio.

In the exemplary embodiment, the reaction of the rosin and the bifunctional epoxy compound is carried out mainly by a ring-opening reaction between a carboxyl group of the rosin and an epoxy group of the bifunctional epoxy compound. At this time, the reaction temperature is preferably higher than or equal to melting points of both constitutional components or a temperature at which the compounds are uniformly mixed, specifically, is in a range of from 60° C. to 200° C., in general. During the reaction, a catalyst for promoting the ring-opening reaction of the epoxy group may be added.

Examples of the catalyst which may be used include amines such as ethylene diamine, trimethyl amine, or 2-methylimidazole; quaternary ammonium salts such as triethyl ammonium bromide, triethyl ammonium chloride, or butyl trimethyl ammonium chloride; and triphenylphosphine.

The reaction may be carried out with various methods. Typically, in the case of a batch process, the reaction progress may be traced by putting the rosin and the bifunctional epoxy compound at a predetermined ratio into a flask capable of heating which is equipped with a cooling tube, a stirring device, an inert gas introduction port, a thermometer, and the like, followed by heating and melting, and sampling the reactant. The reaction progress may be confirmed based on, mainly, a decrease in acid value. Once the reaction progress reaches at or near a stoichiometric reaction end point, the reaction may be completed.

Regarding a reaction ratio of the rosin and the bifunctional epoxy compound, the rosin is caused to react with the bifunctional epoxy compound in an range of preferably 1.5 mol to 2.5 mol, more preferably a range of from 1.8 mol to 2.2 mol, and most preferably a range of from 1.85 mol to 2.1 mol with respect to 1 mol of the bifunctional epoxy compound. When the amount of the rosin is less than 1.5 mol, the epoxy group of the bifunctional epoxy compound remains in the subsequent polyester preparing process. As a result, the molecular weight is increased due to the action as a cross-linking agent, and there is a concern of gelation. On the other hand, when the amount of the rosin is greater than 2.5 mol, unreacted rosin remains, and thus charging properties may deteriorate due to an increase in acid value.

The rosin used in the exemplary embodiment is a generic term for resin acids obtained from trees and shrubs and is a material derived from natural products including abietic acid as one of tricyclic diterpenes and isomers thereof as a major component. Examples of specific components of the rosin include, in addition to abietic acid, palustric acid, neoabietic acid, pimaric acid, dehydroabietic acid, isopimaric acid, and sandaracopimaric acid, and the rosin used in the exemplary embodiment is a mixture of these acids. Based on a collecting method, rosins are classified broadly into three kinds of rosins: tall rosin obtained from a pulp as a raw material; gum rosin obtained from crude turpentine as a raw material; and wood rosin obtained from the stump of a pine as a raw material. As the rosin used in the exemplary embodiment, gum rosin or tall rosin is preferable from the viewpoint of easy availability.

It is preferable that these rosins be purified, and a purified rosin may be obtained by removing, from a crude rosin, a polymer material that is considered to be produced from a peroxide of a resin acid or an non-saponified material contained in the crude rosin. A purifying method is not particularly limited, and various well-known purifying methods may be selected. Specific examples of the purifying method include distillation, recrystallization, and extraction. It is industrially preferable that the rosin be purified by distillation. Typically, the distillation is carried out in consideration of a distillation time in a temperature range of from 200° C. to 300° C. under a pressure of 6.67 kPa or lower. The recrystallization is carried out by, for example, dissolving a crude rosin in a good solvent, removing the solvent by distillation to obtain a thick solution, and adding a poor solvent to this solution. Examples of the good solvent include aromatic hydrocarbons such as benzene, toluene, or xylene; chlorinated hydrocarbons such as chloroform; alcohols such as lower alcohols; ketones such as acetone; and acetic acid esters such as ethyl acetate. Examples of the poor solvent include hydrocarbon-based solvents such as n-hexane, n-heptane, cyclohexane, or isooctane. The extraction is a method of obtaining a purified rosin including: mixing a crude rosin with alkali water to obtain an aqueous alkali solution; extracting an insoluble non-saponified material contained in the aqueous alkali solution therefrom using an organic solvent; and neutralizing the aqueous layer.

The rosin according to the exemplary embodiment may be a disproportionated rosin. The disproportionated rosin is a mixture of dehydroabietic acid and dihydroabietic acid as a major component, in which unstable conjugated double bonds in the molecules are removed by heating a rosin containing abietic acid as a major component at a high temperature in the presence of a disproportionation catalyst.

Examples of the disproportionation catalyst include various well-known catalysts including supported catalysts such as palladium carbon, rhodium carbon, or platinum carbon;

metal powders such as powders of nickel or platinum; iodides such as iodine or iron iodide; and phosphorus-based compounds. The amount of the catalyst used is, in general, preferably from 0.01% by weight to 5% by weight and more preferably from 0.01% by weight to 1% by weight with respect to the rosin. The reaction temperature is preferably from 100° C. to 300° C. and more preferably from 150° to 290° C. In order to control the amount of dehydroabietic acid, for example, dehydroabietic acid isolated by the method of crystallizing an ethanolamine salt from a disproportionated rosin (J. Org. Chem., 31, 4246 (1996)) may be added to the disproportionated rosin, which is prepared by heating at a high temperature in the presence of a disproportion catalyst, so as to achieve a desired amount of dehydroabietic acid.

The rosin according to the exemplary embodiment may be a hydrogenated rosin. The hydrogenated rosin contains tetrahydroabietic acid and dihydroabietic acid as major components, and may be obtained by removing unstable conjugated double bonds in the molecule through a well-known hydrogenation reaction. The hydrogenation reaction is performed by heating a crude rosin in the presence of a hydrogenation catalyst under a hydrogen pressure of generally from 10 $kg/cm^2$ to 200 $kg/cm^2$, and preferably 50 $kg/cm^2$ to 150 $kg/cm^2$. Examples of the hydrogenation catalyst include various well-known catalysts including supported catalysts such as palladium carbon, rhodium carbon, or platinum carbon; metal powders such as powders of nickel or platinum; and iodides such as iodine or iron iodide. The amount of the catalyst used is, in general, preferably from 0.01% by weight to 5% by weight and more preferably from 0.01% by weight to 1.0% by weight with respect to the rosin. The reaction temperature is preferably from 100° C. to 300° C. and more preferably from 150° C. to 290° C.

The disproportionated rosin and the hydrogenated rosin may be purified with the above-described method before or after disproportionation or hydrogenation, respectively.

In addition, the rosin in the present exemplary embodiment may be a polymerized rosin obtained by polymerizing a rosin, an unsaturated carboxylic acid-modified rosin obtained by adding unsaturated carboxylic acid to a rosin, or a phenol-modified rosin. Further, examples of an unsaturated carboxylic acid used for preparing the unsaturated carboxylic acid-modified rosin include maleic acid, maleic anhydride, fumaric acid, acrylic acid, and methacrylic acid. The unsaturated carboxylic acid-modified rosin is obtained by modification using from 1 part by weight to 30 parts by weight of the unsaturated carboxylic acid with respect to 100 parts by weight of the raw material rosin.

Among the rosins, the purified rosin, the disproportionated rosin, and the hydrogenated rosin are preferable as the rosin according to the exemplary embodiment. These rosins may be used alone or as a mixture of two or more kinds.

In the exemplary embodiment, since the unsaturated bond contained in the purified rosin may be crosslinked with the ethylenically unsaturated bond contained in the structure of the specific polyester resin, the purified rosin is more preferable.

Exemplary compounds of the specific rosin diol which may be preferably used in the exemplary embodiment are shown below, but the exemplary embodiment is not limited thereto.

(1)

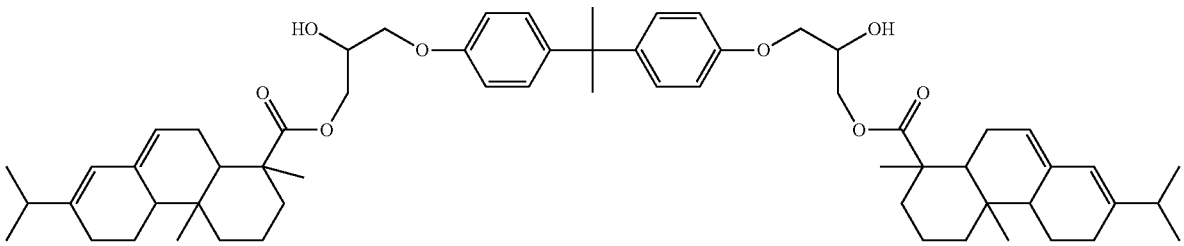

(2)

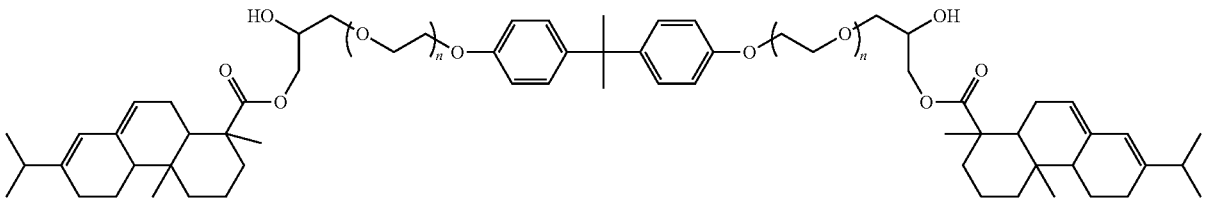

(3)

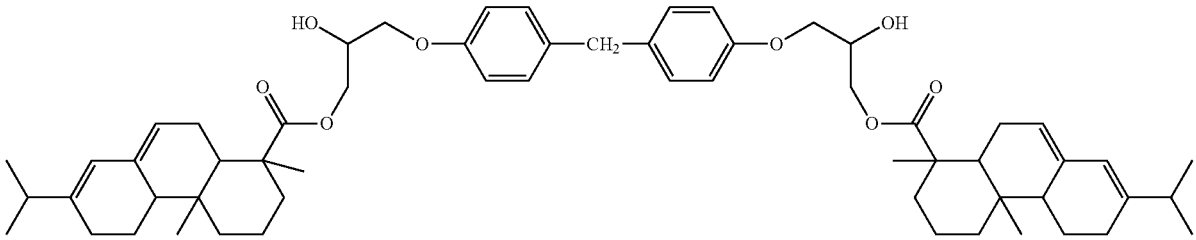

-continued
(4)
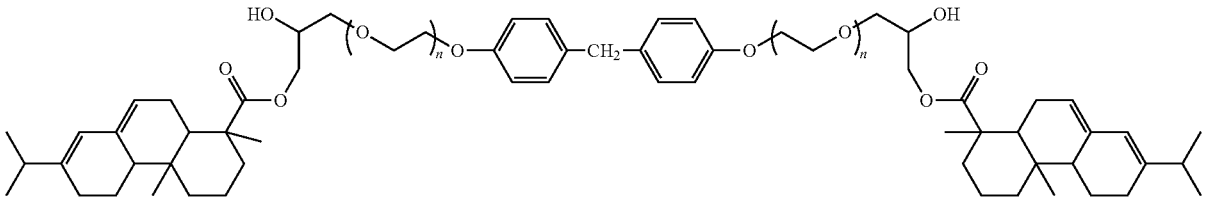
(5)
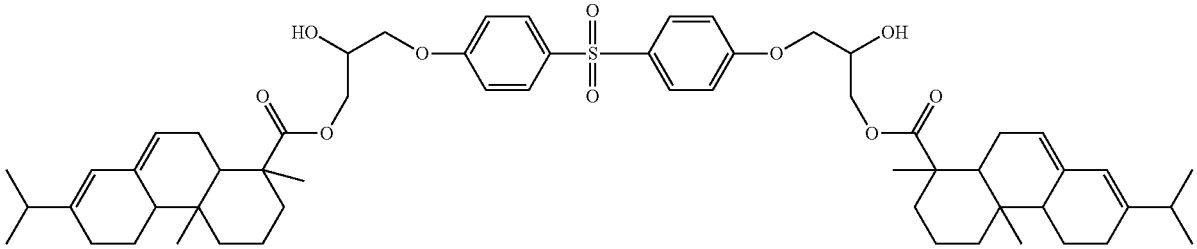
(6)
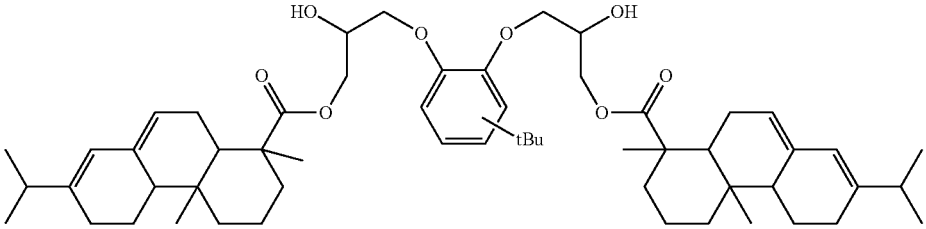
(7)
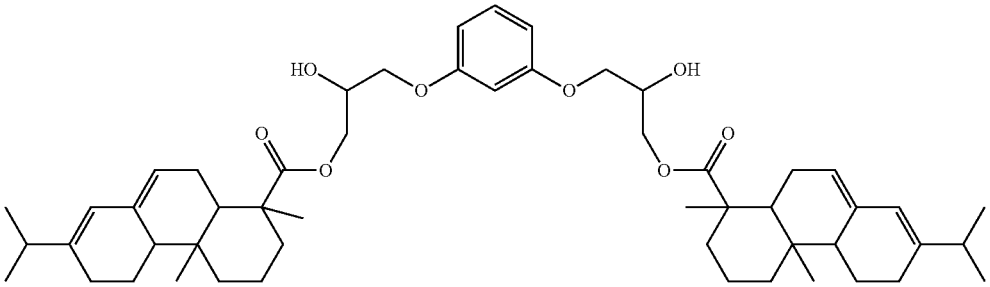
(8)
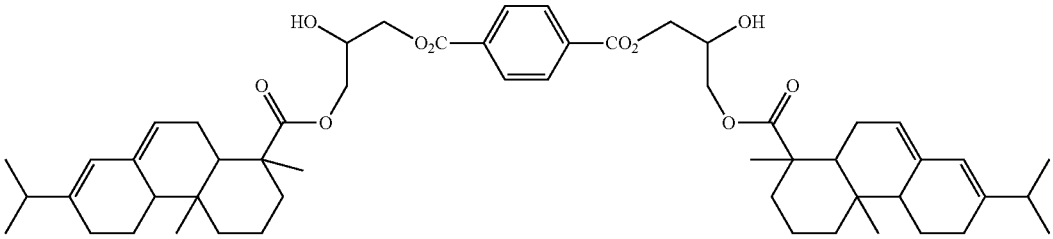
(9)
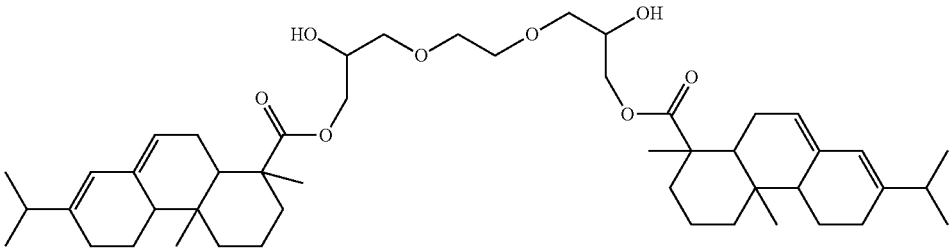

-continued
(10)
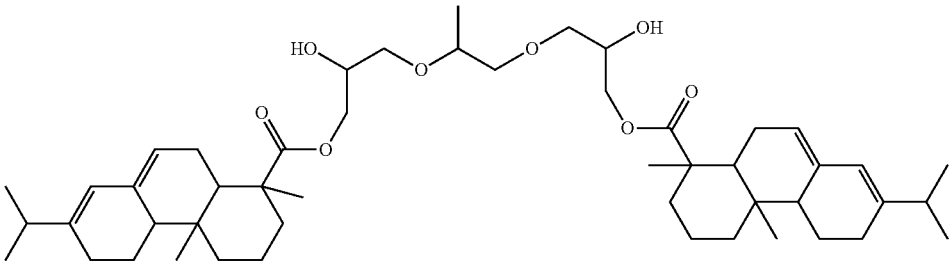
(12)
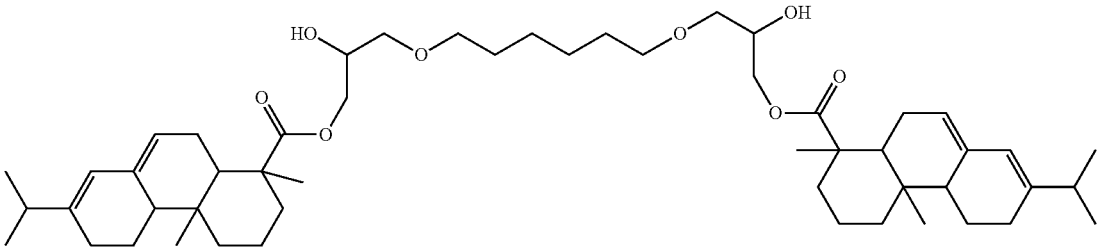
(13)
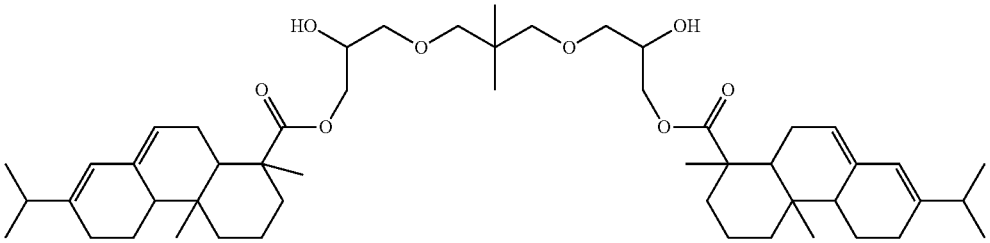
(14)
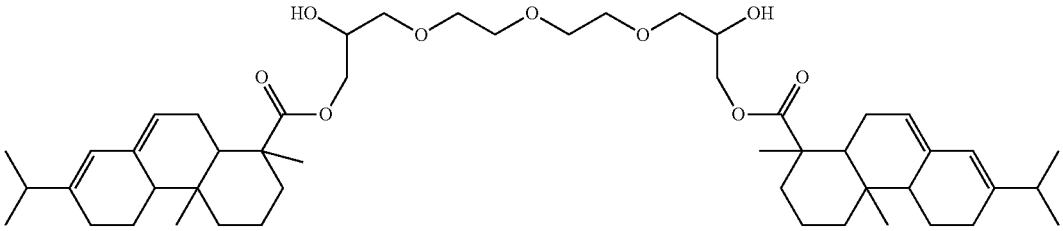
(15)
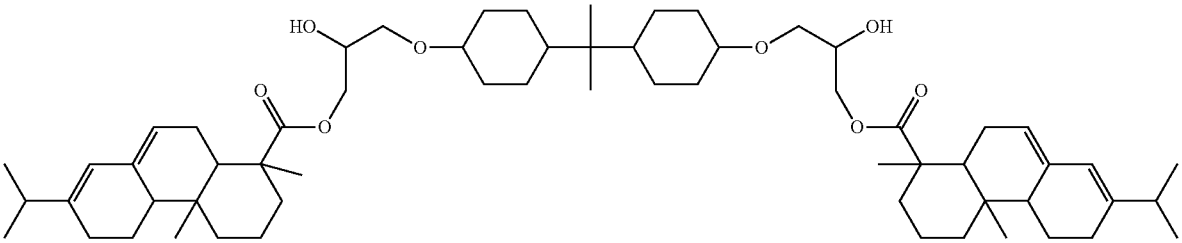
(16)
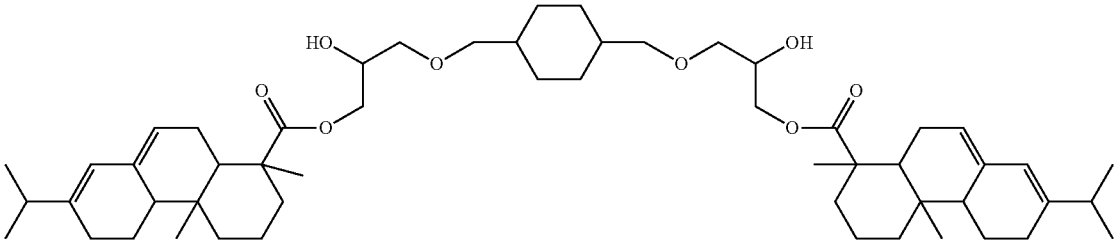

-continued
(17)
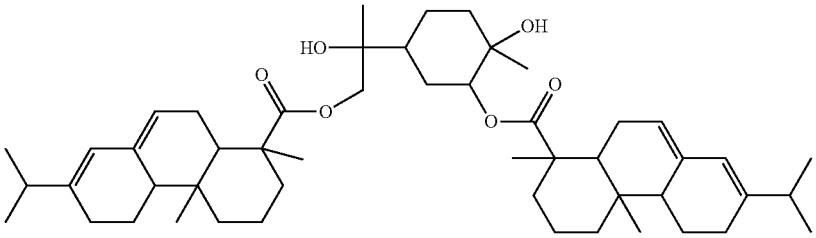
(18)
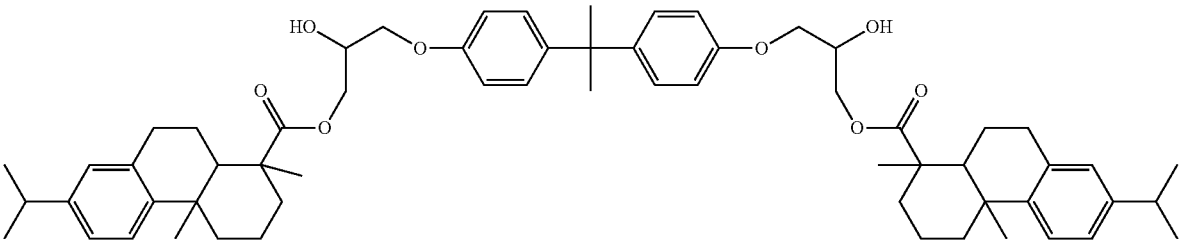
(19)
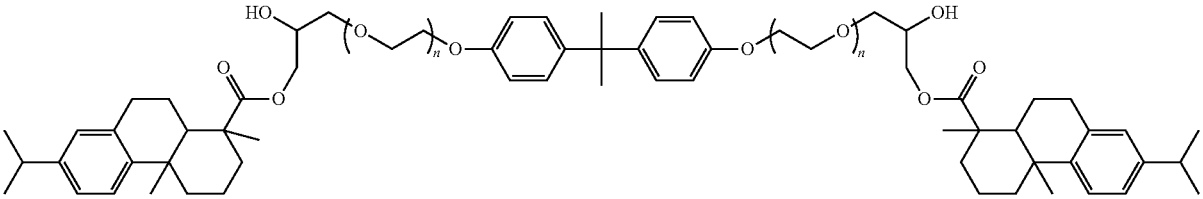
(20)
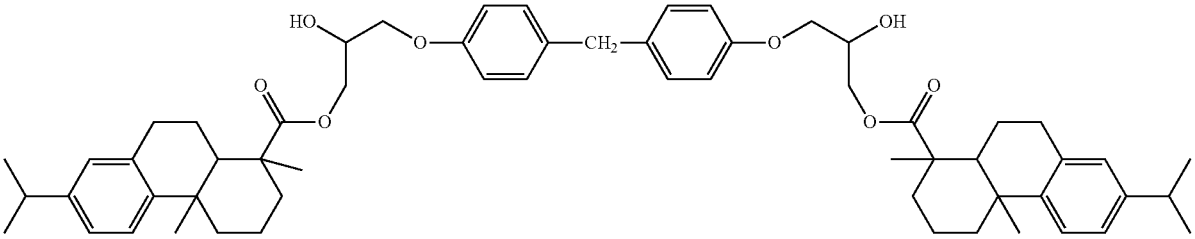
(21)
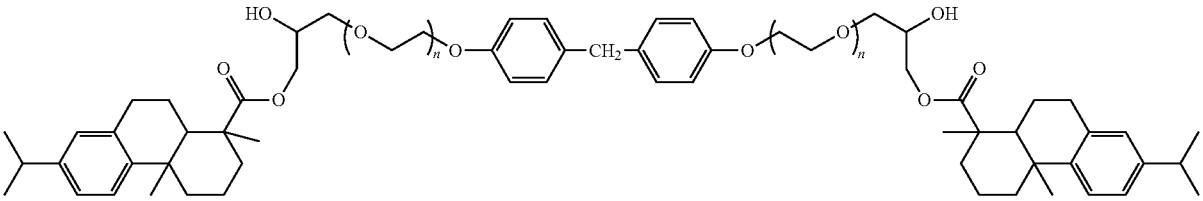
(22)
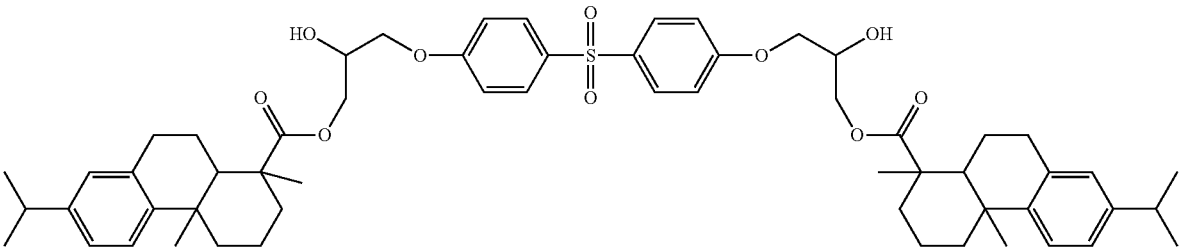

-continued
(23)
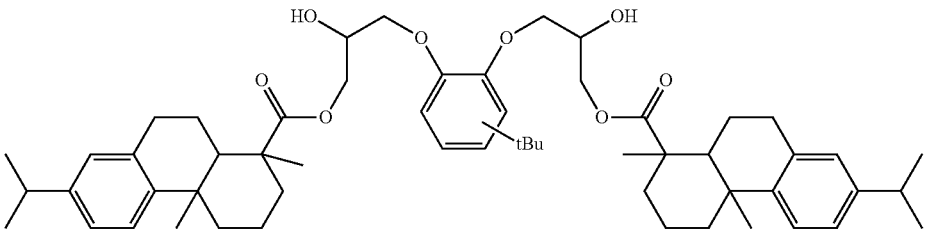
(24)
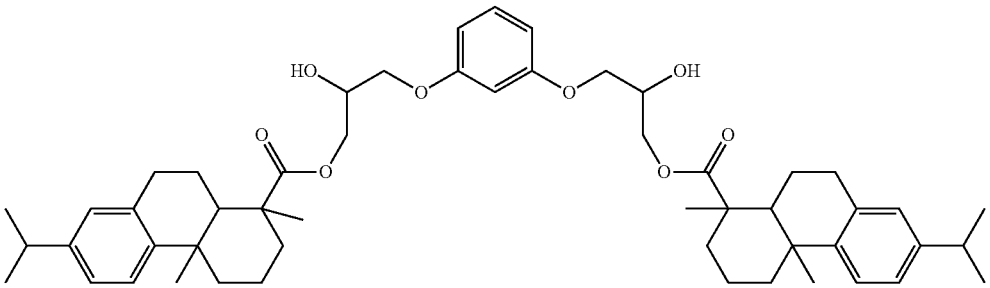
(25)
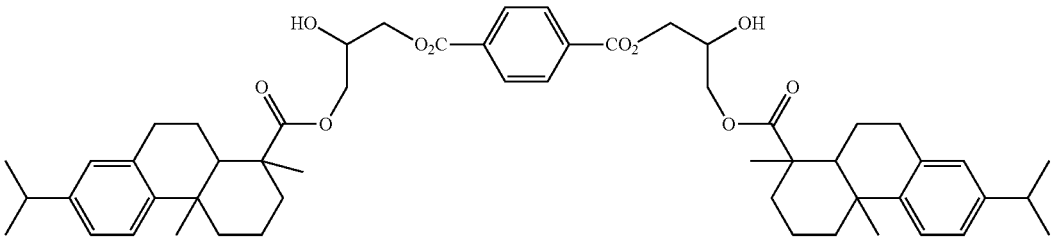
(26)
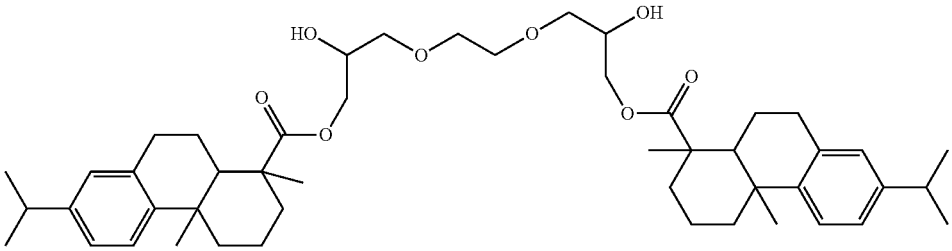
(27)
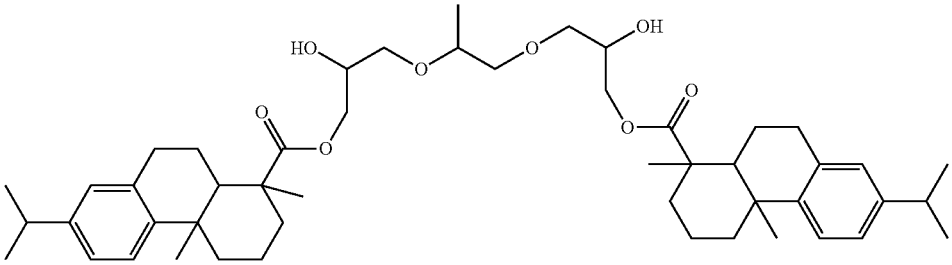
(28)
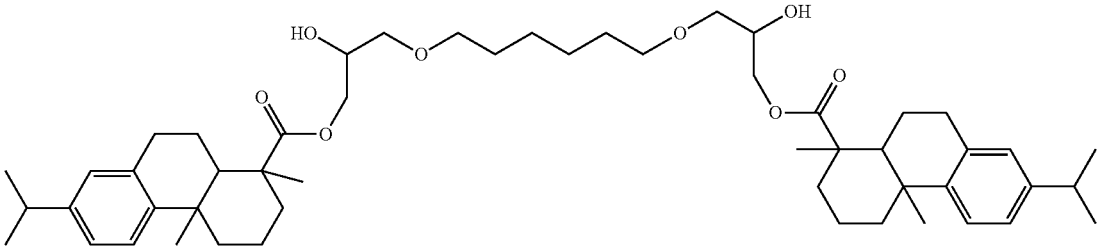

-continued
(29)
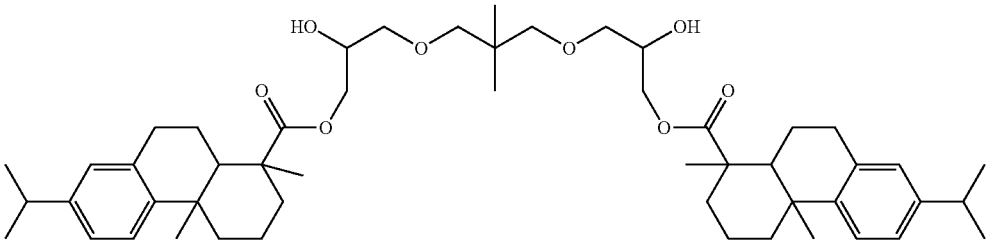
(30)
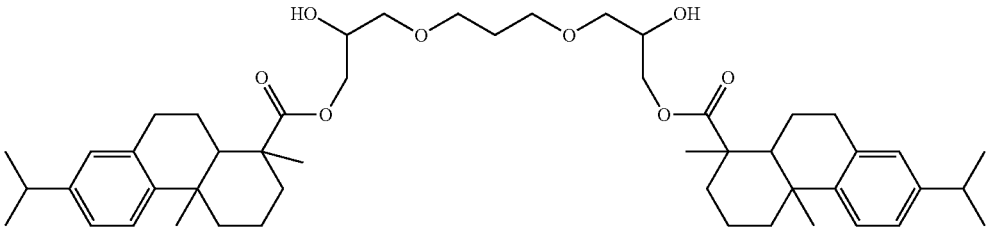
(31)
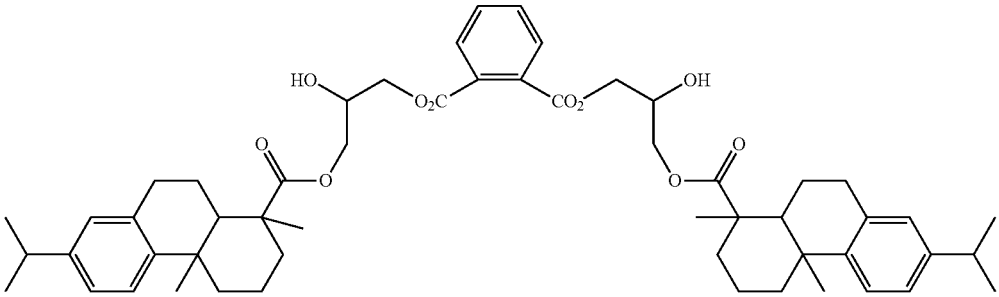
(32)
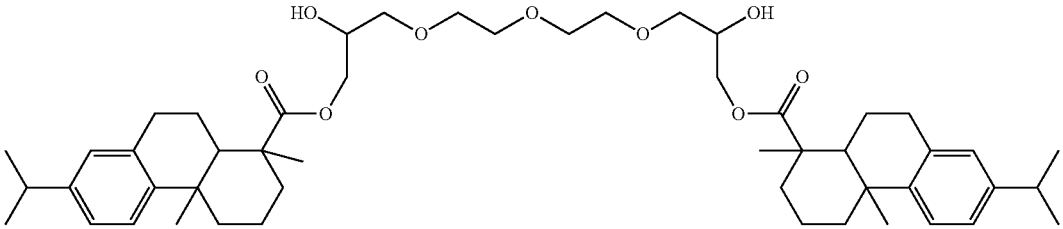
(33)
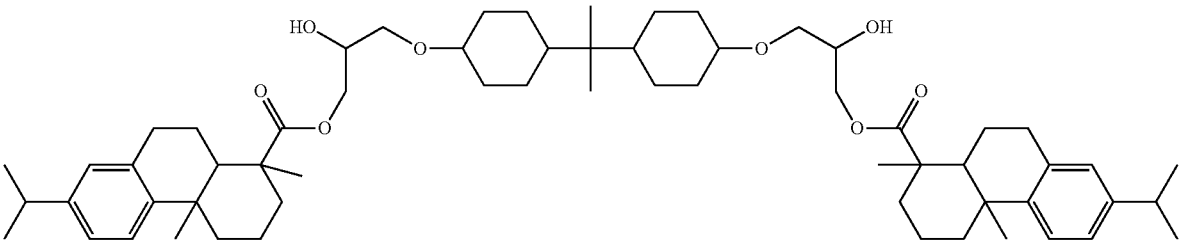
(34)
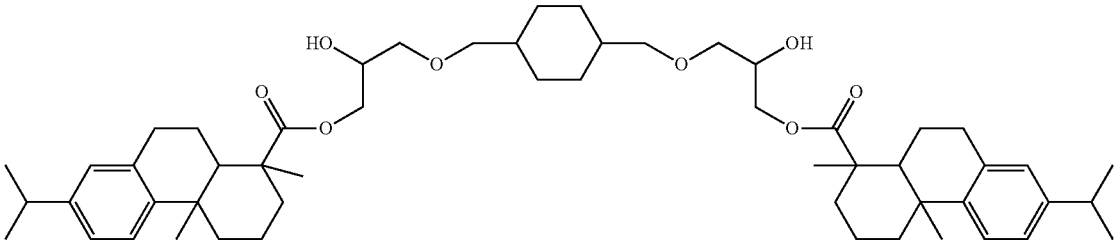

-continued
(35)
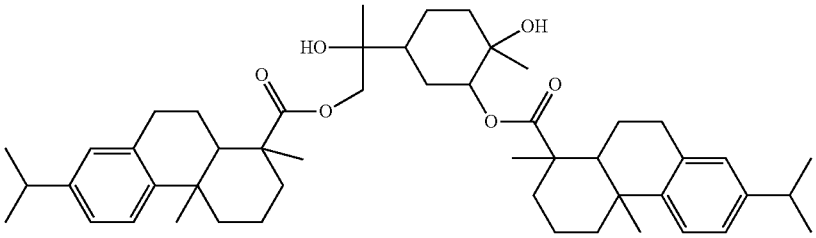
(36)
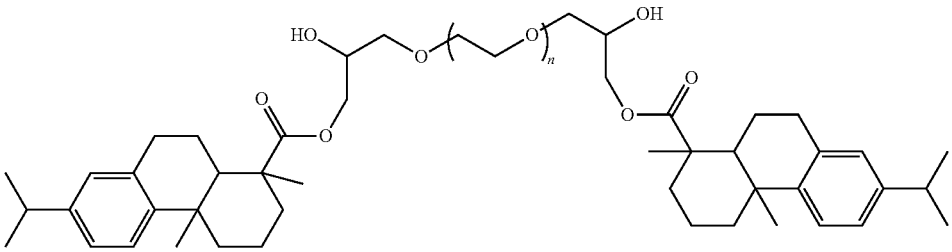
(37)
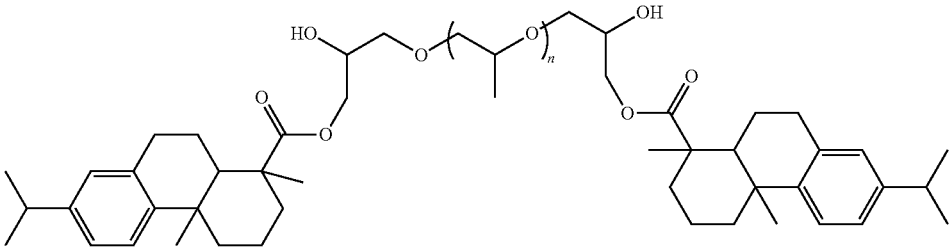
(38)
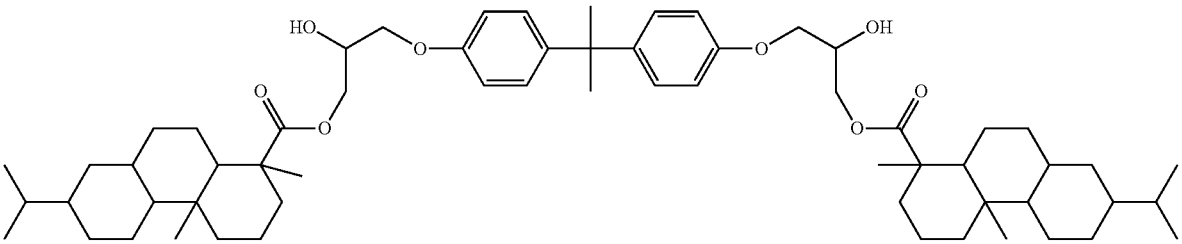
(39)
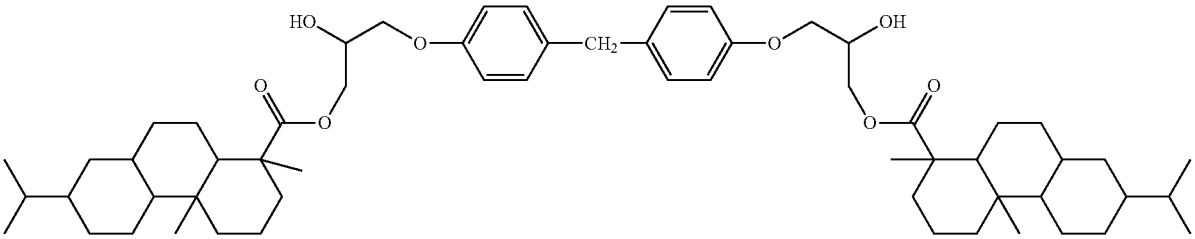
(40)
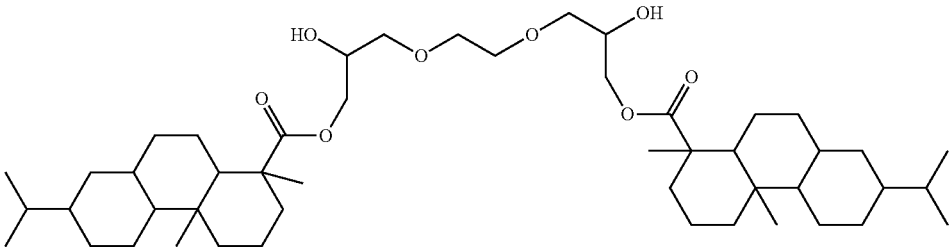

-continued (41)

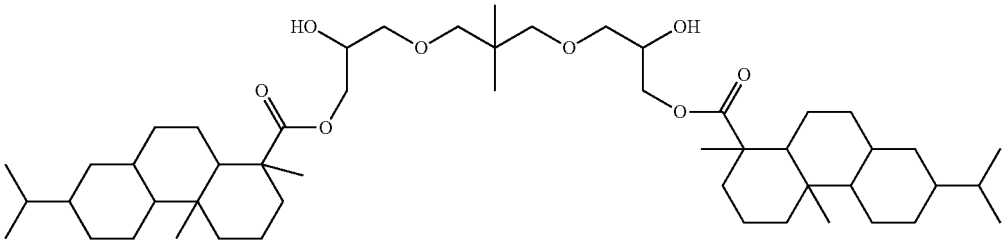

(42)

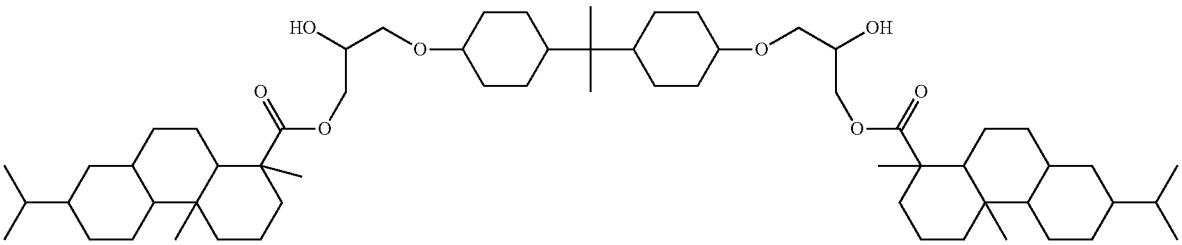

In the exemplary compounds of the specific rosin diol, n represents an integer of 1 or more. In addition, tBu represents a t-butyl group.

In the exemplary embodiment, as the alcohol component, alcohol components other than the dialcohol component having a rosin ester group may be used together. When the alcohol components other than the dialcohol component having a rosin ester group are used together, a ratio (molar ratio) of the structural unit derived from the dialcohol component having a rosin ester group to structural units derived from all the alcohol components is preferably from 10 mol % to 100 mol % and more preferably 20 mol % to 90 mol %.

As the alcohol components other than the dialcohol component having a rosin ester group, at least one selected from the group consisting of aliphatic diols and etherified diphenols may be used in a range in which toner performance does not deteriorate.

Examples of the aliphatic diols include ethylene glycol, 1,2-propanediol, 1,3-propanediol, 1,2-butanediol, 1,3-butanediol, 1,4-butanediol, 2,3-butanediol, 1,4-butenediol, 2-methyl-1,3-propanediol, 1,5-pentanediol, neopentyl glycol, 2-ethyl-2-methylpropane-1,3-diol, 2-butyl-2-ethylpropane-1,3-diol, 1,6-hexanediol, 3-methyl-1,5-pentanediol, 2-ethyl-1,3-hexanediol, 2,4-dimethyl-1,5-pentanediol, 2,2,4-trimethyl-1,3-pentanediol, 1,7-heptanediol, 1,8-octanediol, 1,9-nonanediol, 1,10-decanediol, 3-hydroxy-2,2-dimethylpropyl-3-hydroxy-2,2-dimethylpropanoate, diethylene glycol, triethylene glycol, polyethylene glycol, dipropylene glycol, and polypropylene glycol. These aliphatic diols may be used alone or in a combination of two or more kinds.

In addition, in the exemplary embodiment, an etherified diphenol may be further used in combination with the aliphatic diol. The etherified diphenol is a diol obtained by addition reaction of bisphenol A and an alkylene oxide. As the alkylene oxide, an alkylene oxide which is an ethylene oxide or a propylene oxide and of which the average addition mol number is from 2 mol to 16 mol with respect to 1 mol of the bisphenol A is preferable.

In addition, a trivalent or higher polyvalent polyol may be used within a range not impairing the effects of the exemplary embodiment. Examples of the trivalent or higher polyvalent polyol include glycerin, trimethylolethane, trimethylolpropane, and pentaerythritol. These polyols may be used alone or in a combination of two or more kinds. As the trivalent or higher polyvalent polyol, glycerin and trimethylolpropane are preferable from the viewpoint of easy availability and reactivity.

The specific polyester resin may be prepared with a well-known commonly-used method using the acid component and the alcohol component as raw materials. As a reaction method, any of an ester exchange reaction and a direct esterification reaction may be applied. In addition, polycondensation may be promoted using a method of applying a pressure to increase the reaction temperature or a method of allowing inert gas to flow under reduced pressure or normal pressure. Depending on the reaction, a well-known commonly-used reaction catalyst, for example, at least one metal compound selected from the group consisting of antimony, titanium, tin, zinc, aluminum, and manganese may be used to promote the reaction. The addition amount of the reaction catalyst is preferably from 0.01 part by weight to 1.5 parts by weight and more preferably from 0.05 part by weight to 1.0 part by weight with respect to 100 parts by weight of the total amount of the acid component and the alcohol component. The reaction may be performed at a temperature from 180° C. to 300° C.

Hereinafter, an example of a synthesis scheme of the specific polyester resin will be shown. In the following synthesis scheme, the specific rosin diol is synthesized by allowing the bifunctional epoxy compound and the rosin to react with each other. The specific polyester resin is synthesized by the dehydration polycondensation of the specific rosin diol and the dicarboxylic acid component. In the structural formula representing the specific polyester resin, a portion surrounded by dotted lines corresponds to the rosin ester group according to the exemplary embodiment.

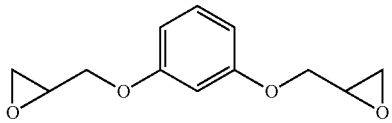
Epoxy compound
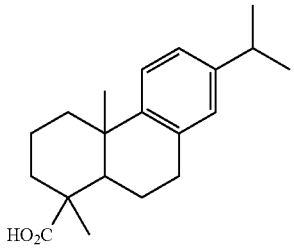
Rosin
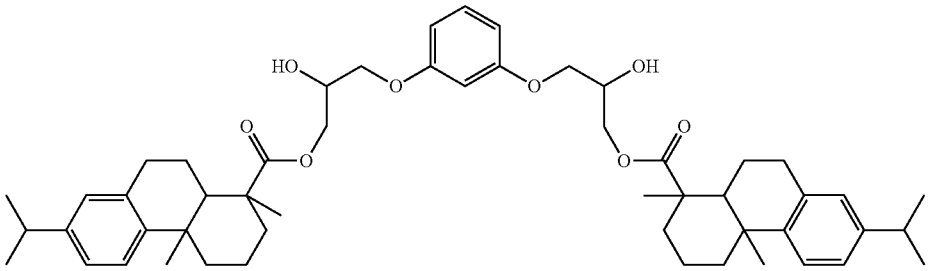
Rosin diol
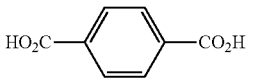
Dicarboxylic acid
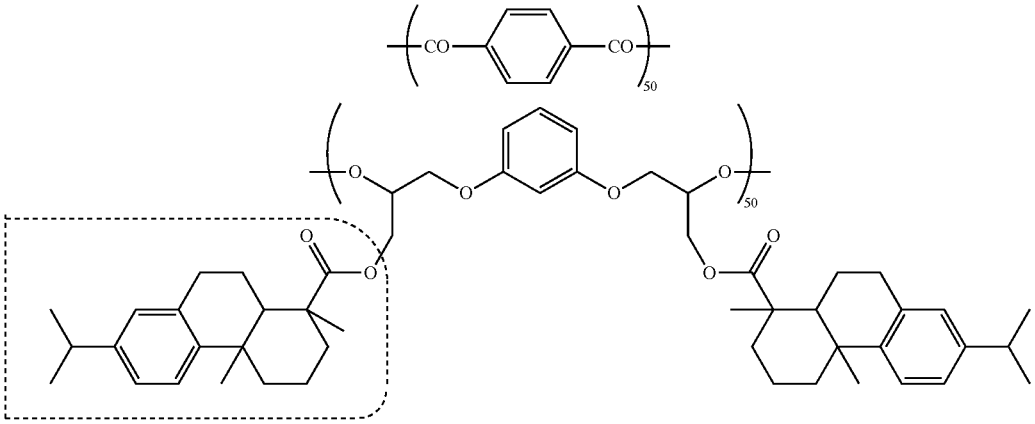
Polyester resin The specific polyester resin is decomposed into the following monomers when being hydrolyzed. Since the polyester is a condensate containing the dicarboxylic acid and the diol at 1:1, the components of the resin may be presumed based on decomposed products.

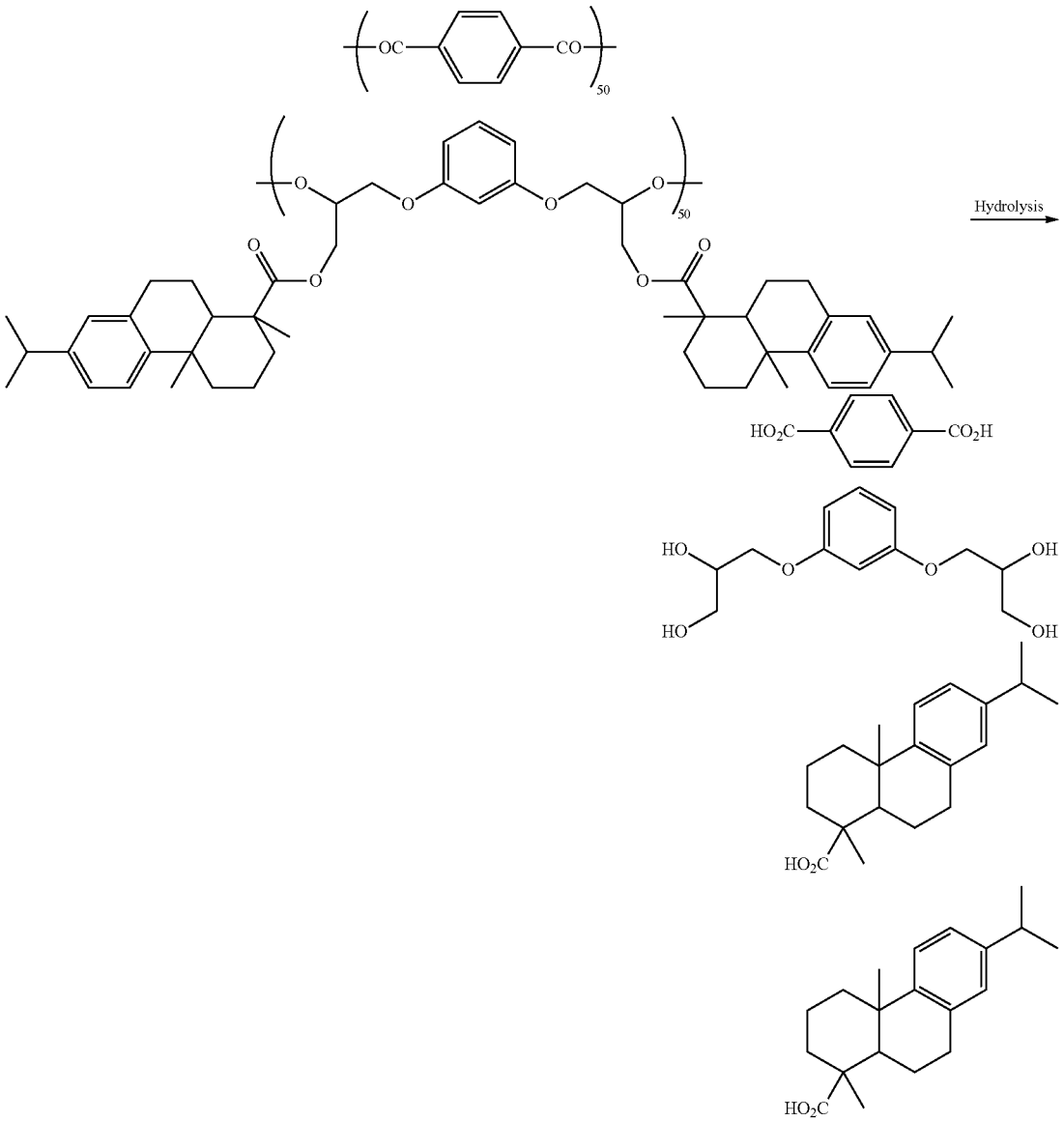

The softening point of the specific polyester resin is preferably from 80° C. to 160° C. and more preferably from 90° C. to 150° C. from the viewpoints of a fixing property, storage stability, and durability of the toner. The glass transition temperature of the specific polyester resin is preferably from 35° C. to 80° C. and more preferably from 40° C. to 70° C. from the viewpoints of the fixing property, storage stability, and durability. The softening point and the glass transition temperature may be easily adjusted by adjusting the raw monomer composition, a polymerization initiator, the molecular weight, the amount of a catalyst, and the like or by selecting reaction conditions.

The acid value of the specific polyester resin is preferably from 3 mg KOH/g to 30 mg KOH/g and more preferably from 9 mg KOH/g to 21 mg KOH/g from the viewpoint of the charging properties of the toner. When the acid value is greater than 30 mg KOH/g, the specific polyester resin is likely to contain moisture, and thus charging properties may deteriorate particularly in a summer environment. When the acid value is less than 3 mg KOH/g, charging properties may significantly deteriorate.

The specific polyester resin contains the rosin ester group. The rosin ester group is a hydrophobic and bulky group. In addition, since an interface between the toner and air is likely to be hydrophobic in general, the rosin ester group is likely to be exposed on the surface of the toner according to the exemplary embodiment containing the specific polyester resin. Particularly, since the specific polyester resin containing the specific rosin diol according to the exemplary embodiment contains the rosin ester group not in the main chain but in a side chain, the degree of freedom is high, and the rosin ester group is more likely to be exposed on the surface. However, when the amount of the rosin ester group exposed on the toner surface is large, charging properties of the toner may deteriorate. In the exemplary embodiment, by controlling the acid value of the specific polyester to be from 3 mg KOH/g to 30 mg KOH/g, the charge amount of the toner is adjusted to a desired value.

From the viewpoints of the durability and hot offset resistance of the toner, the weight average molecular weight of the specific polyester resin is preferably from 4,000 to 1,000,000 and more preferably from 7,000 to 300,000.

The specific polyester resin may be a modified polyester. Examples of the modified polyester include polyesters grafted or blocked using phenol, urethane, epoxy, or the like with a method described in JP-A-11-133668, JP-A-10-239903, or JP-A-8-20636.

By using the specific polyester resin as the binder resin, a toner having superior charge properties may be obtained. In the toner according to the exemplary embodiment, other well-known binder resins including vinyl-based resins such as styrene-acrylic resin, epoxy resins, polycarbonate, or polyurethane may be used together within a range not impairing the effects of the exemplary embodiment. In this case, the content of the specific polyester resin in the binder resin is preferably 70% by weight or greater, more preferably 90% by weight or greater, and still more preferably substantially 100% by weight.

The content of the binder resin is, for example, preferably from 40% by weight to 95% by weight, more preferably from 50% by weight to 90% by weight, and still more preferably from 60% by weight to 85% by weight with respect to the total weight of the toner particles.

Colorant

Examples of the colorant include various pigments such as carbon black, chromium yellow, Hansa yellow, benzidine yellow, threne yellow, quinoline yellow, pigment yellow, permanent orange GTR, pyrazolone orange, Balkan orange, watchung red, permanent red, brilliant carmine 3B, brilliant carmine 6B, DuPont oil red, pyrazolone red, Lithol red, rhodamine B lake, lake red C, pigment red, rose bengal, aniline blue, ultramarine blue, Calco Oil blue, methylene blue chloride, phthalocyanine blue, pigment blue, phthalocyanine green, and Malachite green oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These colorants may be used alone or in a combination of two or more kinds.

Optionally, the colorant may be surface-treated or may be used in combination with a dispersant. In addition, plural kinds of colorants may be used in combination.

The content of the colorant is, for example, preferably from 1% by weight to 30% by weight and more preferably from 3% by weight to 15% by weight with respect to the total weight of the toner particles.

Release Agent

Examples of the release agent include hydrocarbon waxes; natural waxes such as carnauba wax, rice wax, or candelilla wax; synthetic or mineral and petroleum waxes such as montan wax; and ester waxes such as fatty acid esters or montanic acid esters. The release agent is not limited to these examples.

A melting point of the release agent is preferably from 50° C. to 110° C. and more preferably from 60° C. to 100° C.

The melting point may be obtained from a DSC curve obtained by differential scanning calorimetry (DSC) using "melting peak temperature" described in a method of obtaining a melting point according to JIS K-1987 "method of measuring transition temperature of plastics".

The content of the release agent is, for example, preferably from 1% by weight to 20% by weight and more preferably from 5% by weight to 15% by weight with respect to the total weight of the toner particles.

Other Additives

Examples of other additives include well-known additives such as a magnetic material, a charge-controlling agent, or an inorganic powder. The toner particles contain these additives as internal additives.

Properties of Toner Particles

The toner particles may have a single-layer structure or a so-called core-shell structure including a core (core particles) and a coating layer (shell layer) with which the core is coated.

For example, it is preferable that the toner particles having a core-shell structure be composed of: a core including a binder resin and optionally other additives such as a colorant or a release agent; and a coating layer including a binder resin.

In the toner according to the exemplary embodiment, a surface layer portion contains a crosslinked material of the specific polyester resin. In the toner according to the exemplary embodiment containing toner particles and optionally external additives, surface layer portions of the toner particles contain a crosslinked material of the specific polyester resin.

Whether or not the toner (toner particles) according to the exemplary embodiment contains a crosslinked material is verified with the following method.

100 mL of dimethyl sulfoxide and 10 mL of 5 mol/L sodium hydroxide-methanol solution are added with respect to 2 g of the toner or the toner particles, followed by dispersion. A hydrolysis reaction is carried out at room temperature (for example 25° C.) for 12 hours, and the obtained reactant is neutralized with concentrated hydrochloric acid after the reaction. Next, dimethyl formamide is added to prepare a 0.5% by weight solution. The molecular weight (number average molecular weight) of the toner dispersion after the hydrolysis treatment is measured by GPC. When the toner or the toner particles contain a crosslinked material, the number average molecular weight thereof has a mild peak in a range of 3000 or greater. The peak is derived from the crosslinked material of the specific polyester resin which is formed by a polymerization reaction of the ethylenically unsaturated bond contained in the molecules of the specific polyester resin. Based on whether or not a mild peak is present in a number average molecular weight range of 3000 or greater, whether or not the toner (toner particles) according to the exemplary embodiment contains a crosslinked material is determined.

In addition, whether or not the surface of the toner (toner particles) according to the exemplary embodiment contains a crosslinked material is verified with the following method.

C-K shell near-edge X-ray absorption fine structure (NEXAFS) spectra of the surface layer portion and the center portion of the toner are obtained with a scanning transmission X-ray microscope (STXM). Next, regarding a peak at around 288.7 eV derived from the ethylenically unsaturated bond, backgrounds are drawn at 288 eV and 290 eV, a peak area is obtained as a C2p peak, and the C2p peaks of the surface layer portion and the center portion of the toner are obtained. As a result, ratios of the ethylenically unsaturated bond present in the surface layer portion and the center portion may be obtained.

When the C2p peak of the surface layer portion of the toner is decreased as compared to that of the center portion, it may be said that the surface layer portion of the toner (toner particles) contains a crosslinked material.

The volume average particle size (D50v) of the toner particles is preferably from 2 μm to 10 μm and more preferably from 4 μm to 8 μm.

In order to measure various particle sizes and various particle size distribution indices of the toner particles, Coulter Multisizer II (manufactured by Beckman Coulter Inc.) is used, and ISOTON-II (manufactured by Beckman Coulter Inc.) is used as an electrolytic solution.

During the measurement, 0.5 mg to 50 mg of a measurement sample is added to 2 ml of aqueous solution which contains 5% of surfactant (preferably, sodium alkylbenzene sulfonate) as a dispersant. The obtained solution is added to 100 ml to 150 ml of the electrolytic solution.

The electrolytic solution in which the sample is suspended is dispersed using an ultrasonic disperser for 1 minute. Then, using Coulter Multisizer II, the particle size distribution of particles having a particle size in a range from 2 μm to 60 μm is measured using an aperture with an aperture size of 100 μm. The number of particles which are sampled is 50000.

Volume and number cumulative distributions are plotted from the smallest diameter side in particle size ranges (channels) divided based on the measured particle size distribution. Particle sizes having a cumulative value of 16% are defined as a cumulative volume average particle size D16v and a cumulative number average particle size D16p, particle sizes having a cumulative value of 50% are defined as a cumulative volume average particle size D50v and a cumulative number average particle size D50p, and particle sizes having a cumulative value of 84% are defined as a cumulative volume average particle size D84v and a cumulative number average particle size D84p.

Based on these values, a volume average particle size distribution index (GSDv) is calculated from an expression of $(D84v/D16v)^{1/2}$, and a number average particle size distribution index (GSDp) is calculated from an expression of $(D84p/D16p)^{1/2}$.

A shape factor SF1 of the toner particles is preferably from 110 to 150 and more preferably from 120 to 140.

The shape factor SF1 is obtained from the following expression.

$$SF1=(ML^2/A)\times(\pi/4)\times 100 \quad \text{Expression}$$

In the above expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, optical microscopic images of particles scattered on a surface of a glass slide are input to an image analyzer Luzex through a video camera to obtain maximum lengths and projected areas of 100 particles, values of SF1 are calculated using the above expression, and an average value thereof is obtained.

In the exemplary embodiment, a ratio of a tetrahydrofuran (THF) insoluble content (THF insoluble resin) to the total amount of the resin components (the specific polyester resin and other resins which may be used together as the binder resin) is preferably from 0.5% by weight to 5.0% by weight and more preferably from 1.0% by weight to 4.0% by weight.

In order to suppress the peeling of the toner surface material caused by a stress generated inside the toner, the crosslinking of the resin is effective, thereby obtaining preferable properties of the toner. When the resin on the toner surface is crosslinked, the peeling caused by a stress is suppressed. It is preferable that the resin on the toner surface be crosslinked from the viewpoint of maintaining the fixing temperature to be low to some extent.

In the exemplary embodiment, a ratio of the THF insoluble content to the total amount of the resin components is a value measured with the following method.

The toner particles are put into a conical flask, THF is added thereto, and the flask is sealed and left to stand for 24 hours. Next, the solution is poured into a centrifuge glass tube. THF is added to the conical flask to wash the conical flask, and the resultant is poured into the centrifuge glass tube. The centrifuge glass tube is sealed, followed by centrifugal separation for 30 minutes under conditions of a rotating speed of 20,000 rpm and −10° C. After the centrifugal separation, the content is taken out and left to stand. After removing the supernatant liquid, the THF insoluble content of the entire toner is calculated.

A ratio of the resin components in the insoluble content is calculated by TGA. During the measurement, by heating the solution to 600° C. at a temperature increase rate of 20° C./min in a nitrogen stream, the release agent volatilizes in the initial stage, and then the solid content derived from the resin components is thermally decomposed. The remaining component derived from the pigment is thermally decomposed by continuously heating the solution in an air condition. The remaining ash content is the solid content derived from inorganic components. Based on ratios of the above-described components, the ratio of an insoluble content derived from the resin components in the insoluble content may be calculated.

Using the same method, the amount of the resin components in the toner is calculated. Based on the ratio of the amount of the resin components in the insoluble content and the ratio of the amount of the resin components in the toner, the ratio of the THF insoluble content to the total content of the resin components may be calculated.

External Additives

Examples of the external additives include inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, CaO—$SiO_2$, $K_2O.(TiO_2)_n$, $Al_2O_3.2SiO_2$, $CaCO_3$, $MgCO_3$, $BaSO_4$, and $MgSO_4$.

It is preferable that surfaces of the inorganic particles as the external additives be treated with a hydrophobizing agent. The hydrophobizing treatment is performed, for example, by dipping the inorganic particles in a hydrophobizing agent. The hydrophobizing agent is not particularly limited, and examples thereof include a silane coupling agent, silicone oil, a titanate coupling agent, and an aluminum coupling agent. The above-described compounds may be used alone or in a combination of two or more kinds thereof.

The amount of the hydrophobizing agent is, for example, usually from 1 part by weight to 10 parts by weight with respect to 100 parts by weight of the inorganic particles.

Other examples of the external additives include resin particles (for example, resin particles of polystyrene, PMMA (polymethyl methacrylate), melamine resin, and the like) and cleaning activators (for example, metal salts of higher fatty acids represented by zinc stearate and particles of fluorine-based polymers).

The amount of the above-described external additives externally added is, for example, preferably from 0.01% by weight to 5% by weight and more preferably from 0.01% by weight to 2.0% by weight with respect to the toner particles.

The toner particles may be prepared with either a dry method (for example, a kneading and pulverizing method) or a wet method (for example, an aggregation and coalescence method, a suspension polymerization method, or a dissolution suspension method). The method of preparing the toner particles is not limited to these methods, and well-known preparation methods may be adopted.

Among these, it is preferable that the toner particles be obtained with the aggregation and coalescence method.

Specifically, for example, when the toner particles are prepared with the aggregation and coalescence method, the toner particles are obtained through the following steps including a step (resin particle dispersion preparing step) of preparing a resin particle dispersion in which resin particles as a binder resin are dispersed; a step (aggregated particle forming step) of allowing the resin particles (optionally, other particles) to aggregate in the resin particle dispersion (optionally, which is mixed with another particle dispersion) to form aggregated particles; and a step (coalescing step) of heating an aggregated particle dispersion in which the aggregated particles are dispersed and allowing the aggregated particles to coalesce such that the toner particles are formed.

During the preparation of the toner particles, in order for the surface layer portions of the toner particles to contain a crosslinked material of the specific polyester resin, a crosslinking step of crosslinking the specific polyester resin present on the surface layer portions of the toner particles or a attaching step of attaching resin particles containing a crosslinked material of the specific polyester resin onto the surfaces of the toner particles may be performed.

In the crosslinking step, for example, after the coalescing step, a crosslinked material of the specific polyester resin may be formed on the surfaces of the toner particles by adding a polymerization initiator to a toner particle dispersion containing non-crosslinked toner particles to polymerize the specific polyester resin present on the surfaces of the toner particles.

On the other hand, in the attaching step, for example, the resin particles containing a crosslinked material of the specific polyester resin may be attached onto the surfaces of the toner particles by performing a step of forming second aggregated particles (described below) using a resin particle dispersion containing crosslinked particles which are obtained by crosslinking the specific polyester resin.

By performing the crosslinking step or the attaching step, the surface layer portion of the toner according to the exemplary embodiment may be configured to contain a crosslinked material of the specific polyester resin.

When the toner particles is prepared with the kneading and pulverizing method, a crosslinked material of the specific polyester resin may be formed on the surfaces of the toner particles by dispersing the toner particles prepared with the kneading and pulverizing method in an aqueous medium and adding a polymerization initiator to the aqueous medium to polymerize the specific polyester resin present on the surfaces of the toner particles.

Hereinafter, each step will be described in detail.

In the following description, a method of obtaining toner particles which contain a colorant and a release agent will be described, but the colorant and the release agent are optionally used. Of course, additives other than the colorant and the release agent may be used.

Resin Particle Dispersion Preparing Step

First, in addition to a resin particle dispersion in which resin particles as a binder resin are dispersed, for example, a colorant particle dispersion in which colorant particles are dispersed and a release agent particle dispersion in which release agent particles are dispersed are prepared.

In this case, the resin particle dispersion is obtained, for example, by dispersing resin particles in a dispersion medium using a surfactant.

Examples of the dispersion medium which is used for the resin particle dispersion include an aqueous medium.

Examples of the aqueous medium include water such as distilled water or ion exchange water and alcohols. These aqueous mediums may be used alone or in a combination of two or more kinds thereof.

Examples of the surfactant include anionic surfactants such as sulfates, sulfonates, phosphates, or soaps; cationic surfactants such as amine salts or quanternary ammonium salts; and nonionic surfactants such as polyethylene glycols, alkylphenol ethylene oxide adducts, or polyols. Among these, anionic surfactants and cationic surfactants are preferable. Nonionic surfactants may be used in combination with anionic surfactants or cationic surfactants.

These surfactants may be used alone or in a combination of two or more kinds thereof.

Examples of a method of dispersing the resin particles in the dispersion medium to obtain the resin particle dispersion include general dispersing methods using a rotary shearing homogenizer and a ball mill, a sand mill, and a Dyno mill which have a medium. In addition, depending on the kind of resin particles, for example, a phase-transfer emulsification method may be used to disperse the resin particles in the resin particle dispersion.

In the phase-transfer emulsification method, a resin to be dispersed is dissolved in a hydrophobic organic solvent in which the resin is soluble, a base is added to an organic continuous phase (O phase) to neutralize the solution, and an aqueous medium (W phase) is put thereinto such that the conversion of the resin (so-called, phase-transfer) from W/O to O/W occurs to forma discontinuous phase, thereby dispersing the resin in a form of particles in the aqueous medium.

The volume average particle size of the resin particles which are dispersed in the resin particle dispersion is, for example, preferably from 0.01 μm to 1 μm, more preferably from 0.08 μm to 0.8 μm, and still more preferably from 0.1 μm to 0.6 μm.

The volume average particle size of the resin particles is measured as the volume average particle size D50v which is a cumulative value of 50% in a volume cumulative distribution with respect to all the particles. The volume cumulative distribution is plotted from the smallest diameter side in divided particle size ranges (channels) based on a particle size distribution obtained by the measurement of a laser diffraction particle size distribution analyzer (for example, LA-700 manufactured by Horiba Ltd.). The volume average particle sizes of particles in other dispersions are also measured with the same method.

The content of the resin particles in the resin particle dispersion is, for example, preferably from 5% by weight to 50% by weight and more preferably from 10% by weight to 40% by weight.

For example, with the same preparation method as that of the resin particle dispersion, the colorant particle dispersion and the release agent particle dispersion are also prepared. That is, regarding the volume average particle size, dispersion medium, dispersing method, and content of the particles in the resin particle dispersion, the same shall be applied to those of colorant particles which are dispersed in the colorant particle dispersion and release agent particles which are dispersed in the release agent particle dispersion.

Aggregated Particle Forming Step

Next, the resin particle dispersion is mixed with the colorant particle dispersion and the release agent particle dispersion.

In the mixed dispersion, by heteroaggregation of the resin particles, the colorant particles, and the release agent particles, aggregated particles which have a diameter close to desired particle size of the toner particles and contain the resin particles, the colorant particles, and the release agent particles are formed.

Specifically, for example, while adding a coagulant to the mixed dispersion, the pH of the mixed dispersion is controlled to be acidic (for example, ph of from 2 to 5), a dispersion stabilizer is optionally added thereto, and the obtained dispersion is heated to approximately a glass transition temperature of the resin particles (specifically, in a temperature range from the glass transition temperature of the resin particles—30° C. to the glass transition temperature of the resin particles—10° C.) to allow the particles which are dispersed in the mixed dispersion to aggregate. As a result, aggregated particles are formed.

In the aggregated particle forming step, the above-described heating treatment may be performed, for example, after adding the above-described coagulant to the mixed dispersion at room temperature (for example, 25° C.) under stirring with a rotary shearing homogenizer, controlling the pH of the mixed dispersion to be acidic (for example, pH of from 2 to 5), and optionally adding the dispersion stabilizer thereto.

As the coagulant, for example, surfactants having a polarity opposite to that of the surfactant which is added to the mixed dispersion as the dispersant may be used, and examples thereof include inorganic metal salts and di- or higher-valent metal complexes. In particular, when the metal complex is used as the coagulant, the amount of the surfactant used is reduced, and charging properties are improved.

Optionally, an additive which forms a complex or a similar bond with metal ions of the coagulant may be used. As this additive, a chelating agent is preferably used.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide or calcium polysulfide.

As the chelating agent, a water-soluble chelating agent may be used. Examples of the chelating agent include oxycarboxylic acids such as tartaric acid, citric acid, and gluconic acid; imino diacid (IDA); nitrilotriacetic acid (NTA); and ethylenediamine tetraacetic acid (EDTA).

The amount of the chelating agent added is, for example, preferably from 0.01 part by weight to 5.0 parts by weight and more preferably greater than or equal to 0.1 part by weight and less than 3.0 parts by weight with respect to 100 parts by weight of the resin particles.

Coalescing Step

Next, the aggregated particle dispersion in which the aggregated particles are dispersed is heated to a temperature of the glass transition temperature of the resin particles or higher (specifically, to a temperature which is higher than the glass transition temperature of the resin particles by 10° C. to 30° C. or higher) to allow the aggregated particles to coalesce. As a result, the toner particles are formed.

Through the above-described steps, the toner particles are obtained.

The toner particles may be prepared through the steps of: further mixing, after the aggregated particle dispersion in which the aggregated particles are dispersed is obtained, the aggregated particle dispersion with the resin particle dispersion in which the resin particles are dispersed to conduct aggregation so that the resin particles are further adhered to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

After the completion of the coalescing step, optionally, the crosslinking step is performed. Next, the toner particles formed in the solution are subjected to well-known steps including a washing step, a solid-liquid separating step, and a drying step. As a result, dried toner particles are obtained.

In the washing step, it is preferable that displacement washing be sufficiently performed using ion exchange water from the viewpoint of charging properties. In addition, in the solid-liquid separating step, although there is no particular limitation, it is preferable that suction filtration, pressure filtration, or the like be performed from the viewpoint of productivity. In addition, in the drying step, although there is no particular limitation, it is preferable that freeze drying, flush jet drying, fluidized drying, vibrating fluidized drying, or the like be performed from the viewpoint of productivity.

The polymerization initiator used in the crosslinking step is not particularly limited.

Examples of the polymerization initiator used in the exemplary embodiment include a water-soluble polymerization initiator and an oil-soluble polymerization initiator. Examples of the water-soluble polymerization initiator include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-butyl hydroperoxide pertriphenylacetate, tert-butyl performate, tert-butyl peracetate, tert-butyl perbenzoate, tert-butyl perphenylacetate, tert-butyl permethoxyacetate, tert-butyl per-N-(3-toluyl)carbamate, ammonium bisulfate, or sodium bisulfate, but not limited thereto.

In addition, examples of the oil-soluble polymerization initiator include azo-based polymerization initiators such as 2,2'-azobisisobutyronitrile, 2,2'-azobis(2,4-dimethylvaleronitrile), 1,1'-azobis(cyclohexane-1-carbonitrile) and 2,2'-azobis-4-methoxy-2,4-dimethylvaleronitrile.

The toner according to the exemplary embodiment is prepared, for example, by adding the external additives to the dried toner particles thus obtained and mixing them. The mixing may preferably be performed with, for example, a V-blender, a Henschel mixer, a Loedige mixer, or the like. Furthermore, optionally, coarse toner particles may be removed using a vibrating sieve, a wind classifier, or the like.

Electrostatic Charge Image Developer

An electrostatic charge image developer according to an exemplary embodiment of the invention includes at least the toner according to the exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and, for example, well-known carriers may be used. Examples of the carrier include a coated carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin including an organosiloxane bond or a modified product thereof, a fluororesin, polyester, polycarbonate, a phenol resin, and an epoxy resin.

The coating resin and the matrix resin may contain other additives such as a conductive material.

In order to coat the surface of a core with the coating resin, for example, a coating method using a coating layer forming solution in which a coating resin, and optionally, various additives are dissolved in an appropriate solvent may be used. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to exemplary embodiments of the invention will be described.

The image forming apparatus according to this exemplary embodiment includes an image holding member; a charging unit that charges a surface of the image holding member; an electrostatic charge image forming unit that forms an electrostatic charge image on a charged surface of the image holding member; a developing unit that accommodates an electrostatic charge image developer and develops the electrostatic charge image, formed on the surface of the image holding member, using the electrostatic charge image developer to forma toner image; a transfer unit that transfers the toner image, formed on the surface of the image holding member, onto a surface of a recording medium; and a fixing unit that fixes the toner image transferred on the surface of the recording medium. As the electrostatic charge image developer, the electrostatic charge image developer according to the exemplary embodiment is used.

With the image forming apparatus according to the exemplary embodiment, an image forming method (image forming method according to the exemplary embodiment) is performed, and the image forming method includes a charging step of charging a surface of an image holding member; an electrostatic charge image forming step of forming an electrostatic charge image on a charged surface of the image holding member; a developing step of developing the electrostatic charge image, formed on the surface of the image holding member, using the electrostatic charge image developer according to the exemplary embodiment to form a toner image; a transfer step of transferring the toner image, formed on the surface of the image holding member, onto a surface of a recording medium; and a fixing step of fixing the toner image transferred on the surface of the recording medium.

The image forming apparatus according to the exemplary embodiment is applied to various well-known image forming apparatuses such as a direct transfer type apparatus in which a toner image, formed on a surface of an image holding member is directly transferred onto a recording medium; an intermediate transfer type apparatus in which a toner image, formed on a surface of an image holding member, is primarily transferred onto a surface of an intermediate transfer member, and the toner image, transferred onto the surface of the intermediate transfer member, is secondarily transferred onto a surface of a recording medium; an apparatus including a cleaning unit that cleans, after transferring a toner image, a surface of an image holding member before charging the surface again; and an apparatus including an erasing unit that irradiates, after transferring a toner image, a surface of an image holding member with erasing light for erasing before charging the surface again.

In the case of the intermediate transfer type apparatus, the transfer unit includes, for example, an intermediate transfer member onto which a toner image is transferred; a primary transfer unit that primarily transfers the toner image, formed on a surface of an image holding member, onto the surface of the intermediate transfer member; and a secondary transfer unit that secondarily transfers the toner image, transferred onto the surface of the intermediate transfer member, onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that accommodates the electrostatic charge image developer according to the exemplary embodiment and includes the developing unit is preferably used.

Hereinafter, an example of the image forming apparatus according to this exemplary embodiment will be described. However, the image forming apparatus according to this exemplary embodiment is not limited to this example. Major components illustrated in the drawing will be described, and the description of the other components will be omitted.

FIG. 1 is a schematic diagram illustrating a configuration of the image forming apparatus according to this exemplary embodiment.

The image forming apparatus illustrated in FIG. 1 includes first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, also simply referred to as "units") 10Y, 10M, 100, and 10K are arranged in parallel in a horizontal direction thereof at predetermined intervals. These units 10Y, 10M, 10C, and 10K may be process cartridges that are detachable from the image forming apparatus.

An intermediate transfer belt 20 as an intermediate transfer member is provided above the units 10Y, 10M, 100, and 10K in the drawing to extend through the units. The intermediate transfer belt 20 is wound on a driving roll 22 and a support roll 24 contacting the inner surface of the intermediate transfer belt 20, which are separated from each other on the left and right sides in the drawing, and travels in a direction toward the fourth unit 10K from the first unit 10Y. A spring or the like (not illustrated) applies a force to the support roll 24 in a direction away from the driving roll 22, and a tensile strength is given to the intermediate transfer belt 20 wound on both of the rolls. In addition, an intermediate transfer member cleaning device 30 is provided on a surface of the intermediate transfer belt 20 on the image holding member side so as to face the driving roll 22.

Developing devices (developing units) 4Y, 4M, 4C, and 4K of the units 10Y, 10M, 10C, and 10K are supplied with four color toners, that is, a yellow toner, a magenta toner, a cyan toner, and a black toner that are accommodated in toner cartridges 8Y, 8M, 8C, and 8K, respectively.

The first to fourth units 10Y, 10M, 10C, and 10K have the same configuration. Here, the first unit 10Y that is disposed on the upstream side in a traveling direction of the intermediate transfer belt to form a yellow image will be representatively described. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll 2Y (an example of the charging unit) that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 so as to be provided at a position opposed to the photoreceptor 1Y. Furthermore, bias supplies (not illustrated) that apply a primary transfer bias are connected to the primary transfer rolls 5Y, 5M, 5C, and 5K, respectively. Each bias supply changes a transfer bias that is applied to each primary transfer roll under the control of a controller (not illustrated).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with yellow image data sent from the controller (not illustrated). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image that is formed on the photoreceptor 1Y is rotated up to a predetermined developing position along with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being agitated in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner is electrostatically adhered to a latent image part of the surface of the photoreceptor 1Y which is erased, whereby a latent image is developed with the yellow toner. Next, the photoreceptor 1Y on which the yellow toner image is formed travels continuously at a predetermined rate, and the toner image developed on the photoreceptor 1Y is transported onto a predetermined primary transfer position.

When the yellow toner image on the photoreceptor 1Y is transported onto the primary transfer position, a primary transfer bias is applied to the primary transfer roll 5Y, an electrostatic force moving toward the primary transfer roll 5Y from the photoreceptor 1Y acts on the toner image, and the toner image on the photoreceptor 1Y is transferred onto the intermediate transfer belt 20. The transfer bias applied at this time has the opposite polarity (+) of the toner polarity (−), and is controlled to +10 μA, for example, in the first unit 10Y by the controller (not illustrated).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 100, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording paper (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force moving toward the recording paper P from the intermediate transfer belt 20 acts on the toner image, whereby the toner image on the intermediate transfer belt 20 is transferred onto the recording paper P. In this case, the secondary transfer bias is determined depending on the resistance detected by a resistance detector (not illustrated) that detects the resistance of the secondary transfer part, and is voltage-controlled.

Thereafter, the recording paper P is fed to a pressure-contacting part (nip part) between a pair of fixing rolls in a fixing device (an example of the fixing unit) 28 so that the toner image is fixed on the recording paper P, whereby a fixed image is formed.

Examples of the recording paper P onto which a toner image is transferred include plain paper that is used in electrophotographic copiers, printers, and the like. In addition to the recording paper P, an OHP sheet may also be used as the recording medium.

The surface of the recording paper P is preferably smooth in order to further improve smoothness of the image surface after fixing. For example, coating paper obtained by coating a surface of plain paper with a resin or the like, art paper for printing, and the like are preferably used.

The recording paper P on which the fixing of the color image is completed is discharged toward a discharge part, and a series of the color image forming operations ends.

Process Cartridge and Toner Cartridge (Toner Container)

A process cartridge according to an exemplary embodiment of the invention will be described.

The process cartridge according to this exemplary embodiment includes a developing unit that accommodates the electrostatic charge image developer according to the exemplary embodiment and develops an electrostatic charge image, formed on a surface of an image holding member, using the electrostatic charge image developer to forma toner image, and is detachable from an image forming apparatus.

The process cartridge according to this exemplary embodiment is not limited to the above-described configuration, and may include a developing device and, optionally, at least one selected from other units such as an image holding member, a charging unit, an electrostatic charge image forming unit, and a transfer unit.

Hereinafter, an example of the process cartridge according to the exemplary embodiment will be illustrated. However, the process cartridge according to the exemplary embodiment is not limited to this example. Major components illustrated in the drawing will be described, and the description of the other components will be omitted.

Figure 2:
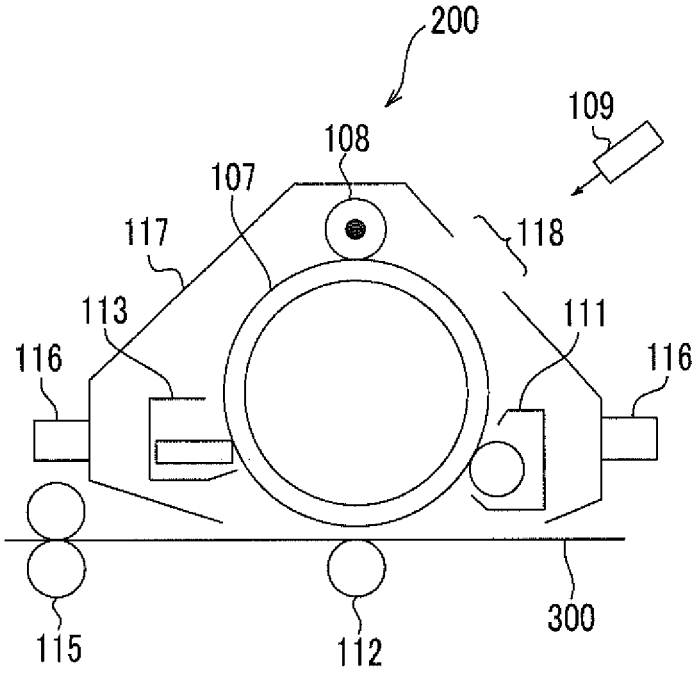
FIG. 2 is a schematic diagram illustrating a configuration example of a process cartridge according to an exemplary embodiment of the invention.

FIG. 2 is a schematic diagram illustrating a configuration of the process cartridge according to the exemplary embodiment.

A process cartridge 200 illustrated in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit) provided around the photoreceptor 107 are integrally combined and held by, for example, a housing 117 provided with a mounting rail 116 and an opening 118 for exposure.

In FIG. 2, reference numeral 109 represents an exposure device (an example of the electrostatic charge image forming unit), reference numeral 112 represents a transfer device (an example of the transfer unit), reference numeral 115 represents a fixing device (an example of the fixing unit), and reference numeral 300 represents a recording paper (an example of the recording medium).

Next, a toner cartridge (toner container) according to an exemplary embodiment of the invention will be described.

The toner cartridge according to the exemplary embodiment accommodates the toner according to the exemplary embodiment and is detachable from an image forming apparatus. The toner cartridge accommodates a toner for replenishment that is supplied to the developing unit provided in the image forming apparatus.

The image forming apparatus illustrated in FIG. 1 has a configuration in which the toner cartridges 8Y, 8M, 8C, and 8K are detachable therefrom, and the developing devices 4Y, 4M, 4C, and 4K are connected to the toner cartridges corresponding to the respective developing devices (colors) through toner supply tubes (not illustrated), respectively. In addition, when the toner accommodated in the toner cartridge runs low, the toner cartridge is replaced.

EXAMPLES

Hereinafter, the exemplary embodiments will be described in detail using examples, but the exemplary embodiments are not limited to the examples.

Example 1

Synthesis of Specific Rosin Diol (1)

113 parts by weight of bisphenol A glycidyl ether (trade name: jER828, manufactured by Mitsubishi Chemical Corporation) as the bifunctional epoxy compound, 200 parts by weight of gum rosin purified with distillation (distillation condition: 6.6 kPa, 220° C.) as the rosin component, and 0.4 part by weight of tetraethylammonium bromide (manufactured by Tokyo Chemical Industry Co., Ltd.) as the reaction catalyst are put into a stainless steel reaction vessel provided with a stirrer, a heater, a cooling tube, and a thermometer. The temperature is increased to 130° C., and a ring-opening reaction between the carboxy group in the rosin and the epoxy group in the epoxy compound is caused. The reaction is continued at the same temperature for 4 hours. Once the acid value reaches 0.5 mg KOH/g, the reaction is stopped, and a specific rosin diol (1) exemplified as the exemplary compound is obtained.

Synthesis of Specific Polyester Resin (1)

300 parts by weight of the specific rosin dial (1) as the dialcohol component, 25 parts by weight of fumaric acid, and 28 parts by weight of terephthalic acid as the dicarboxylic acid component, and 0.3 part by weight of tetra-n-butyl titanate (manufactured by Tokyo Chemical Industry Co., Ltd.) as the reaction catalyst are put into a stainless steel reaction vessel provided with a stirrer, a heater, a thermometer, a fractional distilling instrument, and a nitrogen gas introducing tube. Polycondensation reaction is continued in a nitrogen atmosphere with stirring at 230° C. for 7 hours. After it is confirmed that predetermined molecular weight and acid value are reached, the reaction is stopped. As a result, a specific polyester resin (1) is synthesized.

Preparation of Resin Dispersion (1)

3,000 parts by weight of the obtained specific polyester resin (1), 10,000 parts by weight of ion exchange water, and 90 parts by weight of sodium dodecylbenzenesulfonate are put into an emulsification tank of a high-temperature high-pressure emulsifying device (CAVITRON CD1010). The mixture is heated to 130° C. to be melted, followed by dispersion for 30 minutes under conditions of 110° C., a flow rate of 3 L/m, and 10,000 rpm. The dispersion is allowed to pass through a cooling tank. As a result, a resin dispersion (1)

having a solid content of 30% by weight and a volume average particle size D50v of 113 nm is obtained.

Preparation of Colorant Dispersion 45 parts by weight of carbon black (Regal 330, manufactured by Cabot Corporation), 5 parts by weight of an ionic surfactant (NEOGEN R, manufactured by Dai-Ichi Kogyo Seiyaku Co., Ltd.), and 200 parts by weight of ion exchange water are mixed and dissolved, followed by dispersing with a homogenizer (ULTRA TURRAX, manufactured by IKA Corporation) for 10 minutes and dispersing with an Ultimizer. As a result, a colorant dispersion having a solid content of 20% by weight and a center particle size of 245 nm is obtained.

Preparation of Release Agent Dispersion 45 parts by weight of paraffin wax (HNP0190, manufactured by Nippon Seiro Co., Ltd.), 5 parts by weight of an ionic surfactant (NEOGEN R, manufactured by Dai-Ichi Kogyo Seiyaku Co., Ltd.), and 200 parts by weight of ion exchange water are heated to 120° C. and are dispersed with a pressure discharge Gaulin homogenizer. As a result, a release agent dispersion having a solid content of 20% by weight and a center particle of 219 nm is obtained.

Preparation of Toner Particles 1

400 parts by weight of the resin dispersion (1), 50 parts by weight of the colorant dispersion, 50 parts by weight of the release agent dispersion, 5 parts by weight of aluminum sulfate (manufactured by Wako Pure Chemical Industries Ltd.), 10 parts by weight of sodium dodecylbenzenesulfonate, 50 parts by weight of 0.3 M nitric acid aqueous solution, and 500 parts by weight of ion exchange water are put into a round stainless steel flask, followed by dispersing with a homogenizer (ULTRA TURRAX T-50, manufactured by IKA Corporation). The dispersion is heated to 48° C. in a heating oil bath while stirring. The dispersion is held at 48° C. After it is confirmed that aggregated particles having a volume average particle size of about 5.3 μm are formed, 100 parts by weight of the resin dispersion (1) are further added to the dispersion, and the mixture is held for additional 30 minutes. Next, a 1 N aqueous sodium hydroxide solution is added until the pH reaches 7.0, and the mixture is heated to 80° under stirring and held for 3 hours. A solution in which 1.7 parts by weight of ammonium persulfate is dissolved in 30 parts by weight of ion exchange water is added to the obtained dispersion. The mixed solution is held at a temperature of 80° C. for 3 hours. Reaction products are separated by filtration, are washed with ion exchange water, and are dried with a vacuum drying machine. As a result, toner particles 1 are obtained.

When whether or not a crosslinked material is present on surface portions of the toner particles 1 are examined using the above-described method, it is confirmed that a crosslinked material of the specific polyester resin 1 is present on the surface portions.

Preparation of Toner 1

1.5 parts by weight of hydrophobic silica (TS720, manufactured by Cabot Corporation) is added to 50 parts by weight of the toner particles 1 obtained as above, followed by mixing with a Henschel mixer at a peripheral speed of 30 m/s for 3 minutes. As a result, a toner 1 as an externally added toner is obtained.

Preparation of Developer 1

100 parts by weight of ferrite particles (manufactured by Powdertech Co., Ltd., average particle size: 50 μm), 1.5 parts by weight of polymethyl methacrylate resin (manufactured by Mitsubishi Rayon Co., Ltd., molecular weight: 95000, a ratio of components having a molecular weight of 10000 or less: 5%), and 500 parts by weight of toluene are put into a pressure kneader, followed by stirring and mixing at room temperature (25° C.) for 15 minutes. The mixture is heated to 70° C. while being mixed under reduced pressure to remove toluene by distillation, followed by cooling. The mixture is sieved through a 105 μm sieve. As a result, a resin-coated ferrite carrier is obtained.

This resin-coated ferrite carrier is mixed with the toner 1 as the externally added toner. As a result, a two-component developer 1 having a toner concentration of 7% by weight is prepared.

Evaluation

Low-Temperature Fixing Property

Using a modified machine of DocuCentre-IV C4300 (which is modified so as to perform fixing with an external fixing unit where the fixing temperature may be changed), a solid toner image is formed on paper (JD paper, manufactured by Fuji Xerox Co., Ltd.) in an environment of 25° C. and 55% RH while adjusting the toner deposition amount to 9.8 g/m$^2$. After the toner image is formed, the toner image is fixed using a free belt nip fuser type external fixing unit at a nip width of 6.5 mm and a fixing speed of 150 mm/sec. When the toner image is fixed, the fixing temperature is changed at intervals of 5° C. A low-temperature fixing property is evaluated from a temperature at which a low temperature side offset occurs based on the following criteria. The evaluation result of the low-temperature fixing property of Example 1 is A.

Evaluation Criteria

A: 140° C. or lower

B: Higher than 140° C. and 150° C. or lower

C: Higher than 150° C. and 170° C. or lower

D: Higher than 170° C., poor low-temperature fixing property

Whether or not a low temperature side offset occurs is determined based on whether or not there is a problem in practice.

Filming 10000 solid toner images are formed on paper (JD paper, manufactured by Fuji Xerox Co., Ltd.) in a low-temperature and low-humidity environment of 10° C. and 20% RH while adjusting the toner deposition amount to 4.0 g/m$^2$. Next, 10000 solid toner images are formed on paper (JD paper, manufactured by Fuji Xerox Co., Ltd.) in a high-temperature and high-humidity environment of 32° C. and 85% RH while adjusting the toner deposition amount to 4.0 g/m$^2$. After the images are formed in a high-temperature and high-humidity environment, filming is evaluated by observing whether or not image defects for example, streak defects) caused by filming occur and whether or not a toner-fused material is attached onto the surface of the photoreceptor. The evaluation result of filming of Example 1 is A.

Evaluation Criteria

A: No toner fusion is found on the surface of the photoreceptor, and no defects are found on the images B: An extremely small amount of toner-fused material is found on the surface of the photoreceptor, but no defects are found on the images C: A toner-fused material is found on the surface of the photoreceptor at a level where there are no problems in practice, but no defects are found on the images D: A toner-fused material is found on the surface of the photoreceptor at a level where there are no problems in practice, and defects are also found on the images E: A large amount of toner-fused material is found on the surface of the photoreceptor, and defects are also found on the images A to C are a level where there are no problems in practice.

Example 2

A toner and a developer are prepared with the same method as that of Example 1, except that 25 parts by weight of fumaric acid and 28 parts by weight of terephthalic acid are changed to 15 parts by weight of fumaric acid and 38 parts by weight of terephthalic acid during the synthesis of the specific polyester resin (1). Using the toner and the developer, the same evaluations as those of Example 1 are performed. The obtained results are shown in Table 1.

Example 3

A toner and a developer are prepared with the same method as that of Example 1, except that 25 parts by weight of fumaric acid and 28 parts by weight of terephthalic acid are changed to 37 parts by weight of fumaric acid and 16 parts by weight of terephthalic acid during the synthesis of the specific polyester resin (1). Using the toner and the developer, the same evaluations as those of Example 1 are performed. The obtained results are shown in Table 1.

Example 4

A toner and a developer are prepared with the same method as that of Example 1, except that 1.7 parts by weight of ammonium persulfate is changed to 0.8 part by weight of ammonium persulfate during the preparation of the toner particles 1. Using the toner and the developer, the same evaluations as those of Example 1 are performed. The obtained results are shown in Table 1.

Example 5

A toner and a developer are prepared with the same method as that of Example 1, except that 1.7 parts by weight of ammonium persulfate is changed to 5.1 parts by weight of ammonium persulfate during the preparation of the toner particles 1. Using the toner and the developer, the same evaluations as those of Example 1 are performed. The obtained results are shown in Table 1.

Example 6

A toner and a developer are prepared with the same method as that of Example 1, except that 25 parts by weight of fumaric acid is changed to 25 parts by weight of maleic acid during the synthesis of the specific polyester resin (1). Using the toner and the developer, the same evaluations as those of Example 1 are performed. The obtained results are shown in Table 1.

Example 7

A toner and a developer are prepared with the same method as that of Example 1, except that 1.7 parts by weight of ammonium persulfate is changed to 0.1 part by weight of ammonium persulfate during the preparation of the toner particles 1. Using the toner and the developer, the same evaluations as those of Example 1 are performed. The obtained results are shown in Table 1.

Example 8

A toner and a developer are prepared with the same method as that of Example 1, except that 1.7 parts by weight of ammonium persulfate is changed to 8.5 parts by weight of ammonium persulfate during the preparation of the toner particles 1. Using the toner and the developer, the same evaluations as those of Example 1 are performed. The obtained results are shown in Table 1.

Example 9

Synthesis of Specific Rosin Diol (30)

58 parts by weight of ethylene glycol diglycidyl ether (trade name: EX-810, Mw: 174.19, manufactured by Nagase ChemteX Corporation) as the bifunctional epoxy compound, 200 parts by weight of disproportionated rosin (trade name: PINE CRYSTAL KR614, manufactured by Arakawa Chemical industries, Ltd. Mw: 300.44) as the rosin component, and 0.4 part by weight of tetraethylammonium bromide (manufactured by Tokyo Chemical Industry Co., Ltd.) as the reaction catalyst are put into a stainless steel reaction vessel provided with a stirrer, a heater, a cooling tube, and a thermometer. The temperature is increased to 130° C., and a ring-opening reaction between the carboxy group in the rosin and the epoxy group in the epoxy compound is caused. The reaction is continued at the same temperature for 4 hours. Once the acid value reaches 0.5 rag KOH/g, the reaction is stopped, and a specific rosin diol (30) exemplified as the exemplary compound is obtained.

Synthesis of Specific Polyester Resin (2)

250 parts by weight of the specific rosin diol (30) as the dialcohol component, 20 parts by weight of fumaric acid and 23 parts by weight of terephthalic acid as the dicarboxylic acid component, 17 parts by weight of dodecenylsuccinic anhydride, and 0.3 part by weight of tetra-n-butyl titanate (manufactured by Tokyo Chemical Industry Co., Ltd.) as the reaction catalyst are put into a stainless steel reaction vessel provided with a stirrer, a heater, a thermometer, a fractional distilling instrument, and a nitrogen gas introducing tube. Polycondensation reaction is continued in a nitrogen atmosphere with stirring at 230° C. for 7 hours. After it is confirmed that predetermined molecular weight and acid value are reached, the reaction is stopped. As a result, a specific polyester resin (2) is synthesized.

A toner and a developer are prepared with the same method as that of Example 1, except that the specific polyester resin (1) is changed to the specific polyester resin (2) during the preparation of the resin dispersion (1). Using the toner and the developer, the same evaluations as those of Example 1 are performed. The obtained results are shown in Table 1.

Example 10

A toner and a developer are prepared with the same method as that of Example 1, except that gum rosin is changed to hydrogenated rosin during the synthesis of the specific rosin diol (1); and 10 parts by weight of neopentyl glycol is added as a monomer during the synthesis of the specific polyester resin (1). Using the toner and the developer, the same evaluations as those of Example 1 are performed. The obtained results are shown in Table 1.

Comparative Example 1

A toner and a developer are prepared with the same method as that of Example 1, except that the step of adding 1.7 parts by weight of ammonium persulfate is not performed during the preparation of the toner particles 1. Using the toner and the developer, the same evaluations as those of Example 1 are performed. The obtained results are shown in Table 1.

TABLE 1

| | Example 1 | Example 2 | Example 3 | Example 4 | Example 5 | Example 6 |
|---|---|---|---|---|---|---|
| Acid Component | Fumaric Acid/ Terephthalic Acid | Fumaric Acid/ Terephthalic Acid | Fumaric Acid/ Terephthalic Acid | Fumaric Acid/ Terephthalic Acid | Fumaric Acid/ Terephthalic Acid | Maleic Acid/ Terephthalic Acid |
| Rosin Component | Purified Rosin | Purified Rosin | Purified Rosin | Purified Rosin | Purified Rosin | Purified Rosin |
| THF Insoluble Content | 2.1% | 0.8% | 4.5% | 0.7% | 4.7% | 1.8% |
| Crosslinked Material | Present | Present | Present | Present | Present | Present |
| Filming | A | B | A | B | A | B |
| Low-Temperature Fixing Property | A | A | B | A | B | A |

| | Example 7 | Example 8 | Example 9 | Example 10 | Comparative Example 1 |
|---|---|---|---|---|---|
| Acid Component | Fumaric Acid/ Terephthalic Acid | Fumaric Acid/ Terephthalic Acid | Fumaric Acid/ Terephthalic Acid | Fumaric Acid/ Terephthalic Acid | Fumaric Acid/ Terephthalic Acid |
| Rosin Component | Purified Rosin | Purified Rosin | Disproportionated Rosin | Hydrogeneated Rosin | Purified Rosin |
| THF Insoluble Content | 0.1% | 6.3% | 2.2% | 2.6% | 0% |
| Crosslinked Material | Present | Present | Present | Present | None |
| Filming | C | A | B | B | E |
| Low-Temperature Fixing Property | A | C | A | A | A |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

an unsaturated polyester resin that contains a structural unit derived from a dicarboxylic acid component having an ethylenically unsaturated bond and a structural unit derived from a dialcohol component represented by the following formula (1):

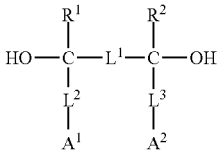

(1)

where in the formula (1):

$R^1$ and $R^2$ each independently represent hydrogen or a methyl group, and may be the same as or different from each other, $L^1$, $L^2$, and $L^3$ each independently represent a divalent linking group selected from the group consisting of a carbonyl group, an ester group, an ether group, a sulfonyl group, a chain alkylene group which may have a substituent, a cyclic alkylene group which may have a substituent, an arylene group which may have a substituent, and combinations thereof; $L^2$ and $L^3$ may be the same as or different from each other; and $L^1$ may form a ring with either $L^2$ or $L^3$, and $A^1$ and $A^2$ represent a rosin ester group, wherein:

a surface layer portion of the toner contains a crosslinked material of the unsaturated polyester resin; and a ratio of a resin component which is insoluble in tetrahydrofuran to a total amount of all the resin components is from 0.5% by weight to 5.0% by weight.

2. The electrostatic charge image developing toner according to claim 1, wherein a ratio of a resin component which is insoluble in tetrahydrofuran to a total amount of all the resin components is from 1.0% by weight to 4.0% by weight.

3. The electrostatic charge image developing toner according to claim 1, wherein a rosin which is a base of the rosin ester group is a purified rosin, a disproportionated rosin, or a hydrogenated rosin.

4. The electrostatic charge image developing toner according to claim 1, wherein a rosin which is a base of the rosin ester group is a purified rosin.

5. An electrostatic charge image developer comprising:

the electrostatic charge image developing toner according to claim 1; and an electrostatic charge image developing carrier.

6. The electrostatic charge image developer according to claim 5, wherein a ratio of a resin component which is insoluble in tetrahydrofuran to a total amount of all the resin components is from 1.0% by weight to 4.0% by weight.

7. The electrostatic charge image developer according to claim 5, wherein a rosin which is a base of the rosin ester group is a purified rosin, a disproportionated rosin, or a hydrogenated rosin.

8. The electrostatic charge image developer according to claim 5, wherein a rosin which is a base of the rosin ester group is a purified rosin.

9. A toner container which accommodates the electrostatic charge image developing toner according to claim 1.

* * * * *